US012342883B2

(12) United States Patent
Roth et al.

(10) Patent No.: US 12,342,883 B2
(45) **Date of Patent: *Jul. 1, 2025**

(54) GARMENT WITH WAISTBAND POCKET

(71) Applicant: Under Armour, Inc., Baltimore, MD (US)

(72) Inventors: Courtney Roth, Baltimore, MD (US); Margaret Snoke, Baltimore, MD (US); Sarah Brunette, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 91 days.

This patent is subject to a terminal disclaimer.

(21) Appl. No.: 18/299,688

(22) Filed: Apr. 12, 2023

(65) Prior Publication Data

US 2023/0320443 A1 Oct. 12, 2023

Related U.S. Application Data

(63) Continuation-in-part of application No. 17/545,307, filed on Dec. 8, 2021, now Pat. No. 11,925,223,
(Continued)

(51) Int. Cl.
*A41D 27/20* (2006.01)
*A41D 1/085* (2018.01)
(Continued)

(52) U.S. Cl.
CPC ..... *A41D 27/205* (2013.01); *A41D 1/085* (2018.01); *A41D 27/207* (2013.01); *A41F 9/00* (2013.01);
(Continued)

(58) Field of Classification Search
CPC ..... A41D 27/205; A41D 1/085; A41D 27/207
See application file for complete search history.

(56) References Cited

U.S. PATENT DOCUMENTS 1,920,061 A 7/1933 Carr
2,164,281 A 6/1939 Mcdonald
(Continued)

FOREIGN PATENT DOCUMENTS

AU 2012254915 A1 6/2013
CN 2805419 Y 8/2006
(Continued)

OTHER PUBLICATIONS

ATHLETA Catalog, Runabout Pant, Item J, p. 37, Fall 2011, Petaluma, California.
(Continued)

*Primary Examiner* — Khaled Annis
(74) *Attorney, Agent, or Firm* — Maginot, Moore & Beck, LLP

(57) ABSTRACT

A garment includes a lower portion and a waistband coupled to the lower portion and configured to be oriented around a waist of the person wearing the garment. The waistband includes a first flap and a second flap. The first flap includes a top edge and an opposite arcuate edge. The second flap includes a top edge and an opposite bottom edge, wherein the first flap and the second flap overlap. A pocket panel is coupled to the waistband of the garment and defines a pocket with an opening to the pocket. The opening to the pocket is defined along a laterally-extending first perimeter portion of the pocket panel and a laterally-extending second perimeter portion of the pocket panel. The first flap is coupled to the first perimeter portion of the pocket panel and the second flap is coupled to the second perimeter portion of the pocket panel.

20 Claims, 31 Drawing Sheets

Related U.S. Application Data which is a continuation of application No. 16/527,831, filed on Jul. 31, 2019, now Pat. No. 11,224,258, which is a continuation of application No. 15/439,006, filed on Feb. 22, 2017, now Pat. No. 10,398,183, application No. 18/299,688 is a continuation-in-part of application No. 16/785,017, filed on Feb. 7, 2020, now Pat. No. 11,779,070, which is a continuation of application No. 15/229,224, filed on Aug. 5, 2016, now abandoned.

(60) Provisional application No. 62/298,102, filed on Feb. 22, 2016.

(51) Int. Cl.

| | |
|---|---|
| ***A41F 9/00*** | (2006.01) |
| *A41B 9/00* | (2006.01) |
| *A41B 9/02* | (2006.01) |
| *A41D 1/08* | (2018.01) |
| *A41D 1/21* | (2018.01) |
| *A41D 13/00* | (2006.01) |

(52) U.S. Cl.

CPC ..... *A41B 9/001* (2013.01); *A41B 9/004* (2013.01); *A41B 9/02* (2013.01); *A41B 9/023* (2013.01); *A41B 9/026* (2013.01); *A41D 1/08* (2013.01); *A41D 1/21* (2018.01); *A41D 13/0012* (2013.01)

(56) References Cited

U.S. PATENT DOCUMENTS

| | | | |
|---|---|---|---|
| 2,255,931 | A | 9/1941 | Kloster |
| 2,438,310 | A | 3/1948 | Ashe et al. |
| 2,492,862 | A | 12/1949 | Harvey |
| 2,930,046 | A | 3/1960 | Stanley |
| 3,137,862 | A | 6/1964 | Basil |
| 3,487,833 | A | 1/1970 | Senser |
| 3,871,030 | A | 3/1975 | Green |
| D235,937 | S | 7/1975 | Froidh |
| 4,006,494 | A | 2/1977 | Knoppel |
| D275,619 | S | 9/1984 | Birring |
| 4,533,355 | A | 8/1985 | Fair |
| D281,540 | S | 12/1985 | Ternstrom |
| D284,036 | S | 6/1986 | Birring |
| 4,660,551 | A | 4/1987 | Nishimura |
| 4,852,188 | A | 8/1989 | Marsh et al. |
| 4,967,768 | A | 11/1990 | Tatro |
| D315,630 | S | 3/1991 | Larsen |
| 5,012,543 | A | 5/1991 | Lewis, Sr. et al. |
| 5,134,726 | A | 8/1992 | Ross |
| 5,161,257 | A | 11/1992 | Arensdorf et al. |
| 5,172,430 | A | 12/1992 | Lerma-Solis |
| 5,210,882 | A | 5/1993 | Moretz et al. |
| D339,902 | S | 10/1993 | Doherty |
| 5,544,366 | A | 8/1996 | Kato |
| 5,555,568 | A | 9/1996 | Yon |
| 5,561,865 | A | 10/1996 | Fjelstul |
| D378,947 | S | 4/1997 | Desmond |
| 5,630,232 | A | 5/1997 | Miller et al. |
| 5,649,328 | A | 7/1997 | Martin |
| D382,386 | S | 8/1997 | Malone |
| 5,671,481 | A | 9/1997 | Giard |
| 5,675,842 | A | 10/1997 | Schaefer |
| 5,724,679 | A | 3/1998 | Hans |
| 5,870,777 | A | 2/1999 | Hans |
| 5,954,564 | A | 9/1999 | Ganz |
| 6,006,363 | A | 12/1999 | Karlin |
| 6,023,789 | A | 2/2000 | Wilson et al. |
| 6,041,441 | A | 3/2000 | Counts et al. |
| 6,047,408 | A | 4/2000 | Brill, Jr. et al. |
| 6,076,195 | A | 6/2000 | Klein |
| 6,145,132 | A | 11/2000 | Towner |
| 6,148,443 | A | 11/2000 | Maastricht |
| 6,161,222 | A | 12/2000 | Strickland et al. |
| 6,363,538 | B1 | 4/2002 | Davis |
| 6,425,140 | B1 | 7/2002 | Vitches |
| 6,532,599 | B1 | 3/2003 | Dugan |
| 6,901,607 | B1 | 6/2005 | Elwell |
| 6,961,964 | B2 | 11/2005 | Blenkarn |
| 6,964,065 | B2 | 11/2005 | Stevenson |
| D514,774 | S | 2/2006 | Africa et al. |
| D515,282 | S | 2/2006 | Africa et al. |
| 6,993,940 | B2 | 2/2006 | Rabinowicz et al. |
| 7,024,703 | B1 | 4/2006 | Della Ratta |
| D532,958 | S | 12/2006 | Kent |
| 7,231,672 | B2 | 6/2007 | Thomas |
| 7,364,491 | B2 | 4/2008 | Updyke |
| D572,430 | S | 7/2008 | Wong |
| 7,434,273 | B2 | 10/2008 | Chung |
| D613,037 | S | 4/2010 | Iamartino et al. |
| D613,928 | S | 4/2010 | Iamartino et al. |
| D615,279 | S | 5/2010 | Savage |
| D618,434 | S | 6/2010 | Iamartino et al. |
| D618,435 | S | 6/2010 | Iamartino et al. |
| D619,784 | S | 7/2010 | Kanada et al. |
| 7,753,759 | B2 | 7/2010 | Pintor et al. |
| 7,788,739 | B1 | 9/2010 | Della Ratta |
| 7,926,123 | B2 | 4/2011 | Walburg |
| D641,134 | S | 7/2011 | Zarabi |
| D641,539 | S | 7/2011 | Zarabi |
| D645,644 | S | 9/2011 | Tamartino |
| D646,047 | S | 10/2011 | Arensdorf |
| 8,028,345 | B2 | 10/2011 | Waite et al. |
| D650,589 | S | 12/2011 | Overton et al. |
| 8,104,654 | B2 | 1/2012 | Overton |
| D654,661 | S | 2/2012 | Savage |
| D659,290 | S | 5/2012 | Overton |
| D660,553 | S | 5/2012 | Farina et al. |
| D661,872 | S | 6/2012 | Iamartino |
| D662,281 | S | 6/2012 | Iamartino |
| D663,075 | S | 7/2012 | Overton |
| 8,214,922 | B2 | 7/2012 | Moore et al. |
| 8,257,140 | B2 | 9/2012 | Kenny |
| 8,272,073 | B2 | 9/2012 | Arensdorf et al. |
| D668,434 | S | 10/2012 | Iamartino |
| 8,312,568 | B2 | 11/2012 | Marois et al. |
| 8,321,964 | B2 | 12/2012 | Gernes |
| D673,756 | S | 1/2013 | Agnew et al. |
| 8,407,816 | B2 | 4/2013 | Rhoades, II et al. |
| 8,458,819 | B1 | 6/2013 | Hoole |
| D686,801 | S | 7/2013 | Farina |
| D687,214 | S | 8/2013 | Farina et al. |
| 8,523,713 | B2 | 9/2013 | Roman |
| 8,555,419 | B2 | 10/2013 | Demarest et al. |
| 8,597,222 | B2 | 12/2013 | Lucero et al. |
| 8,615,816 | B2 | 12/2013 | Harimoto |
| D702,018 | S | 4/2014 | Ferraro |
| D702,918 | S | 4/2014 | Radford et al. |
| 8,745,768 | B1 | 6/2014 | Moghaddas |
| 8,938,815 | B2 | 1/2015 | Vaughn |
| D722,742 | S | 2/2015 | Abrams |
| 9,021,615 | B2 | 5/2015 | Cockram |
| D740,549 | S | 10/2015 | Nejjar |
| D741,045 | S | 10/2015 | Scherr et al. |
| D743,144 | S | 11/2015 | Swan |
| D746,022 | S | 12/2015 | Maier |
| D747,844 | S | 1/2016 | Dawson |
| D747,845 | S | 1/2016 | Pasloski |
| 9,254,010 | B2 | 2/2016 | Hedrick |
| D753,896 | S | 4/2016 | Yoo |
| 9,307,792 | B2 | 4/2016 | Crissman |
| D756,069 | S | 5/2016 | Astin |
| D759,345 | S | 6/2016 | Astin |
| 9,375,035 | B1 | 6/2016 | Ingels |
| D764,765 | S | 8/2016 | Diakonov |
| D768,357 | S | 10/2016 | White et al. |
| 10,398,183 | B2 | 9/2019 | Berns et al. |
| 10,555,572 | B2 * | 2/2020 | Diakonov ..... A41F 9/00 |
| 10,834,983 | B2 * | 11/2020 | Cherry ..... A41D 27/20 |
| 11,224,258 | B2 * | 1/2022 | Berns ..... A41F 9/00 |
| 11,576,479 | B2 * | 2/2023 | Mozafari ..... A45F 3/005 |

(56) References Cited

U.S. PATENT DOCUMENTS

| | | | |
|---|---|---|---|
| 2004/0031830 | A1 | 2/2004 | Davis |
| 2008/0083055 | A1 | 4/2008 | Onda |
| 2008/0189832 | A1 | 8/2008 | Oscher |
| 2008/0295225 | A1 | 12/2008 | Hendrickson et al. |
| 2009/0067150 | A1 | 3/2009 | Ito |
| 2009/0300818 | A1 | 12/2009 | Waite et al. |
| 2010/0281595 | A1 | 11/2010 | Gernes |
| 2011/0009793 | A1 | 1/2011 | Lucero et al. |
| 2011/0131705 | A1 | 6/2011 | Waldman et al. |
| 2011/0225700 | A1 | 9/2011 | Kogut |
| 2012/0030864 | A1 | 2/2012 | Marois et al. |
| 2012/0036615 | A1 | 2/2012 | Bradstreet et al. |
| 2012/0084903 | A1 | 4/2012 | Roberts et al. |
| 2012/0311758 | A1 | 12/2012 | Nicholson et al. |
| 2013/0026203 | A1 | 1/2013 | Overton |
| 2013/0048687 | A1 | 2/2013 | Do |
| 2013/0091619 | A1 | 4/2013 | Hacker et al. |
| 2013/0095730 | A1 | 4/2013 | Jensen |
| 2013/0276210 | A1 | 10/2013 | Clarke et al. |
| 2013/0303052 | A1 | 11/2013 | Conrad |
| 2013/0305433 | A1 | 11/2013 | Hedrick |
| 2014/0115747 | A1 | 5/2014 | Spruill et al. |
| 2014/0143936 | A1 | 5/2014 | Flanagan |
| 2014/0182044 | A1 | 7/2014 | Cole |
| 2014/0196194 | A1 | 7/2014 | Clarke et al. |
| 2014/0273743 | A1 | 9/2014 | Hays et al. |
| 2014/0276325 | A1 | 9/2014 | Turkbas |
| 2014/0283281 | A1 | 9/2014 | Willis |
| 2015/0128331 | A1 | 5/2015 | Grosse |
| 2015/0189921 | A1 | 7/2015 | Callahan |
| 2015/0216245 | A1 | 8/2015 | Kinsley |
| 2015/0257459 | A1 | 9/2015 | Cockram |
| 2016/0338435 | A1 | 11/2016 | Aihara |
| 2017/0238634 | A1 | 8/2017 | Berns et al. |
| 2018/0035736 | A1* | 2/2018 | Le ..... A41D 27/204 |
| 2018/0206567 | A1 | 7/2018 | Diakonov |
| 2018/0228232 | A1 | 8/2018 | Fisher |
| 2019/0297972 | A1* | 10/2019 | Holmes ..... A41F 9/025 |
| 2019/0350281 | A1 | 11/2019 | Berns et al. |
| 2023/0320443 | A1* | 10/2023 | Roth ..... A41D 27/207 2/253 |

FOREIGN PATENT DOCUMENTS

| | | | |
|---|---|---|---|
| DE | 19850874 | A1 | 2/2000 |
| EP | 0164309 | A2 | 12/1985 |
| EP | 0493864 | A1 | 7/1992 |
| GB | 2482934 | A | 2/2012 |
| JP | 2012101902 | A | 5/2012 |
| JP | 2012171673 | A | 9/2012 |
| WO | 9222463 | A1 | 12/1992 |
| WO | 2007088566 | A2 | 8/2007 |
| WO | 2008137810 | A1 | 11/2008 |
| WO | 2010010340 | A2 | 1/2010 |
| WO | 2013020083 | A1 | 2/2013 |

OTHER PUBLICATIONS

ATHLETA Catalog, Organic Cotton Salamba Pant p. 64, Fall 2011, Petaluma, California.

ATHLETA Catalog, Kickbooty Pant, p. 65, Fall 2011, Petaluma, California.

* cited by examiner

GARMENT WITH WAISTBAND POCKET

CROSS-REFERENCE TO RELATED APPLICATIONS

This application is a continuation-in-part of U.S. patent application Ser. No. 16/785,017, filed Feb. 7, 2020, which is a continuation of U.S. patent application Ser. No. 15/229,224, filed Aug. 5, 2016; this application is also a continuation-in-part of U.S. patent application Ser. No. 17/545,307, filed Dec. 8, 2021, which is a continuation of U.S. patent Ser. No. 16/527,831, filed Jul. 31, 2019, now U.S. Pat. No. 11,224,258, which is a continuation of U.S. patent application Ser. No. 15/439,006, filed Feb. 22, 2017, now U.S. Pat. No. 10,398,183, which claims priority from U.S. Provisional Patent Application No. 62/298,102 filed on Feb. 22, 2016, the entire contents of which are incorporated by reference herein.

FIELD

The present disclosure relates to an article of clothing or garment. More specifically, the present invention relates to pants, shorts, and other types of bottoms that contain a pocket with a tension closure, the pocket being configured to receive objects therein.

BACKGROUND

Garments typically are equipped with pockets that enable the wearer of the garment to store items within the pockets. Garments equipped with conventional pockets allow items to fall out of the pocket, especially when the wearer of the garment is performing athletic activity. Thus, garments equipped with conventional pockets are often equipped with fasteners that enable the conventional pockets to securely store any items placed within the pockets. In addition, athletic garments equipped with conventional pockets may cause the garment to be uncomfortable and/or create unwanted and unflattering lines or bulges in the surface of the garment. Therefore, it would be desirable to provide an article of clothing, or garment, that is equipped with a pocket that securely stores personal items without the need for fastener. It would also be desirable to provide a garment that retains personal items in a pocket while athletic activities and movements are performed by the wearer of the garment.

SUMMARY

A garment is disclosed herein including a lower portion and a waistband. The lower portion is configured to be positioned around at least one leg of a person wearing the garment. The waistband is coupled to the lower portion and configured to be oriented around a waist of the person wearing the garment. The waistband includes a first flap and a second flap. The first flap includes a top edge and an opposite arcuate edge. The second flap includes a top edge and an opposite bottom edge, wherein the first flap and the second flap overlap on the waistband of the garment. A pocket panel is coupled to the waistband of the garment. The pocket panel defines a pocket with an opening to the pocket. The opening to the pocket is defined along a laterally-extending first perimeter portion of the pocket panel and a laterally-extending second perimeter portion of the pocket panel. The first flap is coupled to the first perimeter portion of the pocket panel and the second flap is coupled to the second perimeter portion of the pocket panel.

In at least one embodiment of the garment, the waistband includes a top perimeter and a bottom perimeter with a leg portion coupled to the bottom perimeter of the waistband. The waistband further includes a dynamic pocket. The dynamic pocket comprises a pleated resilient sheet disposed on the waistband, the resilient sheet comprising a left side, a right side, a laterally extending first end, and a laterally extending second end opposite the first end. The left side and the right side of the resilient sheet define sides of a pocket cavity of the dynamic pocket. An opening to the pocket cavity is defined between the laterally extending first end and the laterally extending second end of the resilient sheet. The resilient sheet includes a plurality pleats defined by a plurality of fold lines. The plurality of pleats are configured to unfold along the plurality of fold lines to increase a height of the pocket cavity.

In at least one embodiment a method of storing an object in a garment including a waistband pocket is disclosed. The method comprises obtaining a garment including a waistband defining a user-facing interior surface, an exterior surface opposite the interior surface, a top edge, and a bottom edge, the waistband comprising a first flap overlapping a second flap along separable overlapping surface portions on the exterior surface of the waistband. A leg portion of the garment is coupled to the bottom edge of the waistband, and a dynamic pocket is included on the waistband. The dynamic pocket is provided by a pleated resilient sheet, the pleated resilient sheet comprising a left side, a right side, a laterally extending first end coupled to the first flap, and a laterally extending second end coupled to the second flap. An opening to a pocket cavity is defined between the laterally extending first end and the laterally extending second end of the resilient sheet, the resilient sheet including a plurality pleats defined by a plurality of fold lines, wherein the plurality of pleats are configured to unfold along the plurality of fold lines to increase a height of the pocket cavity. The method further includes separating the first flap from the second flap along the overlapping exterior surface portions on the exterior of the waistband, and inserting an object into the pocket cavity such that the pleats unfold and increase the height of the resilient sheet.

The above described features and advantages, as well as others, will become more readily apparent to those of ordinary skill in the art by reference to the following detailed description and accompanying drawings. While it would be desirable to provide a garment with a waistband pocket and associated method for using a waistband pocket that provides one or more of these or other advantageous features as may be apparent to those reviewing this disclosure, the teachings disclosed herein extend to those embodiments which fall within the scope of the appended claims, regardless of whether they include or accomplish one or more of the advantages or features mentioned herein.

BRIEF DESCRIPTION OF THE DRAWINGS

Like reference numerals have been used to identify like elements throughout this disclosure.

Figure 1:
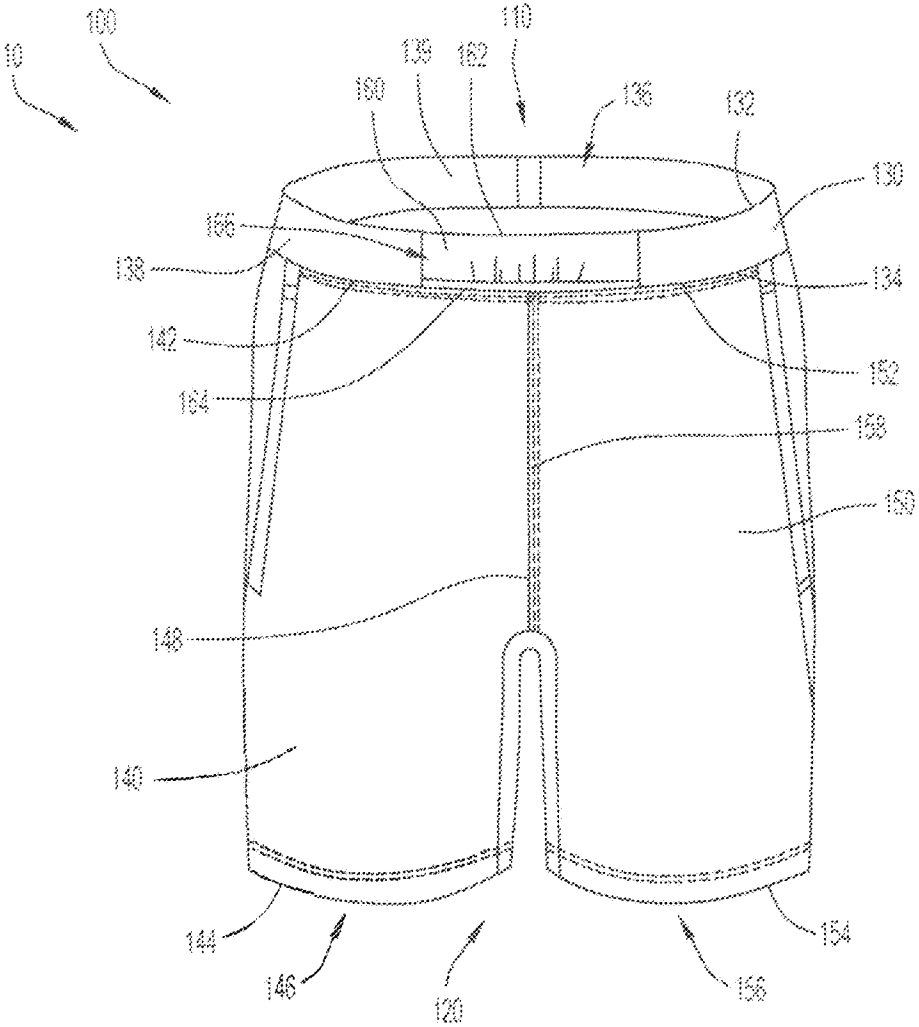
FIG. 1 illustrates a front view of a garment in accordance with a first embodiment of the present invention.

All Figures © Under Armour, Inc. 2023. All rights reserved.

DESCRIPTION

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

As used herein, a "garment" refers to an article of apparel designed and configured to be worn on a user's body. Examples of garments include, but are not limited to: shirts, pants, dresses, bodysuits, packs, and/or any of various other garments referred to herein. The illustrated embodiments depict pants in the form of shorts, though the reader should appreciate that the embodiments described herein may be used with any desired garment, including other types and forms of pants.

It will be recognized that although the garment may be placed in any number of orientations during times of use and non-use by a wearer, terms of position used herein in association with the garment are defined with reference to the garment being worn by a user standing in an upright position. Accordingly, "vertical" references a direction that is generally perpendicular to the ground and is defined from a user's feet to the user's head (or vice-versa). Similarly, "horizontal" and/or "lateral" references a direction that is generally parallel to the ground and is defined from the user's left to right side (or vice-versa). Likewise, the terms "above" and "upper" references a relative position where one component is vertically higher than another component, and "below" or "lower" references a relative position where one component is vertically lower than another component.

A garment is disclosed herein that includes a waistband pocket. The pocket is provided by a pocket panel disposed on the waistband. In various embodiments, the pocket panel may be expandable such that the height of the pocket panel increases when an object of a particular size is inserted into the pocket. The pocket panel may be accessed via two flaps coupled to the waistband. In at least some embodiments, the two flaps are overlapping and assist in securing an object in the pocket.

Garment with Exterior Waist Pocket

Referring to FIGS. 1, 2, 3, and 4, illustrated is a first embodiment of a garment that can be worn by a person, where the garment includes a pocket in the waistband of the garment. The embodiment of the garment illustrated is a pair of pants 10. The term pants may refer to any type of bottom typically worn by people, including, but not limited to, pants, knickers, capris, shorts, trousers, skirts, kilts, etc. The pants 10 contain a front side 100, and a rear side 200, the rear side 200 oriented opposite of the front side 100. The pants 10 further include a first (e.g., right) side 300 connecting the front side 100 to the rear side 200. The pants 10 also include a second (e.g., left) side 400 that is oriented opposite of the first side 300 and that also connects the front side 100 to the rear side 200. The pants further include a top side 110 (which may also be referred to herein as an "upper portion") and a bottom side 120 (which may also be referred to herein as a "bottom portion") oriented opposite of the top side 110.

The embodiment of the pants 10 illustrated in FIGS. 1, 2, 3, and 4 may contain a waist portion 130 (which may also be referred to herein as a "waistband") on the top side 110, and a first leg portion 140 and a second leg portion 150 on the bottom side 120. As illustrated, the waist portion, or waistband, 130 is disposed proximate to the top 110 of the pants 10 and includes a top edge 132 and a bottom edge 134. The waist portion 130 extends around each of the sides 100, 200, 300, 400 of the pants 10 and defines opening 136 proximate to the top side 110 of the pants 10. Opening 136 is configured to receive portions of the body of the user wearing the pants 10. When worn by a user, the waist portion 130 of the pants 10 is configured to encircle or surround the user proximate to the user's waist. The waist portion 130 further includes an exterior surface 138 and an interior surface 139. When worn by a user, the interior surface 139 of the waist portion 130 contacts the portion of the body in which the waist portion encircles, while the exterior surface 138 remains exposed.

As described herein, the waist portion 130 of the pants 10 can be constructed of any suitable elastomeric fabric materials, including elastomeric fabrics that provide two-way stretch or four-way stretch characteristics so as to provide a form-fitting or compression fit against the user's body. Elastomeric fabrics can be formed from yarns, fibers and/or filaments using any suitable types of elastomeric and/or non-elastomeric components. An example of an elastomeric materials for use in forming the fabric materials for the pants are polyester-polyurethane copolymers used to form synthetic yarns, fibers or filaments and commonly referred to as spandex or elastane. Fabrics formed from yarns or fibers comprising spandex or elastane provide significant elasticity to the fabric so as to achieve a desired form or compression fit to the user's body. In one embodiment, the waist portion 130 may be constructed from a woven polyester/stretch blended fabric that contains 86% polyester and 14% elastane.

Figure 2:
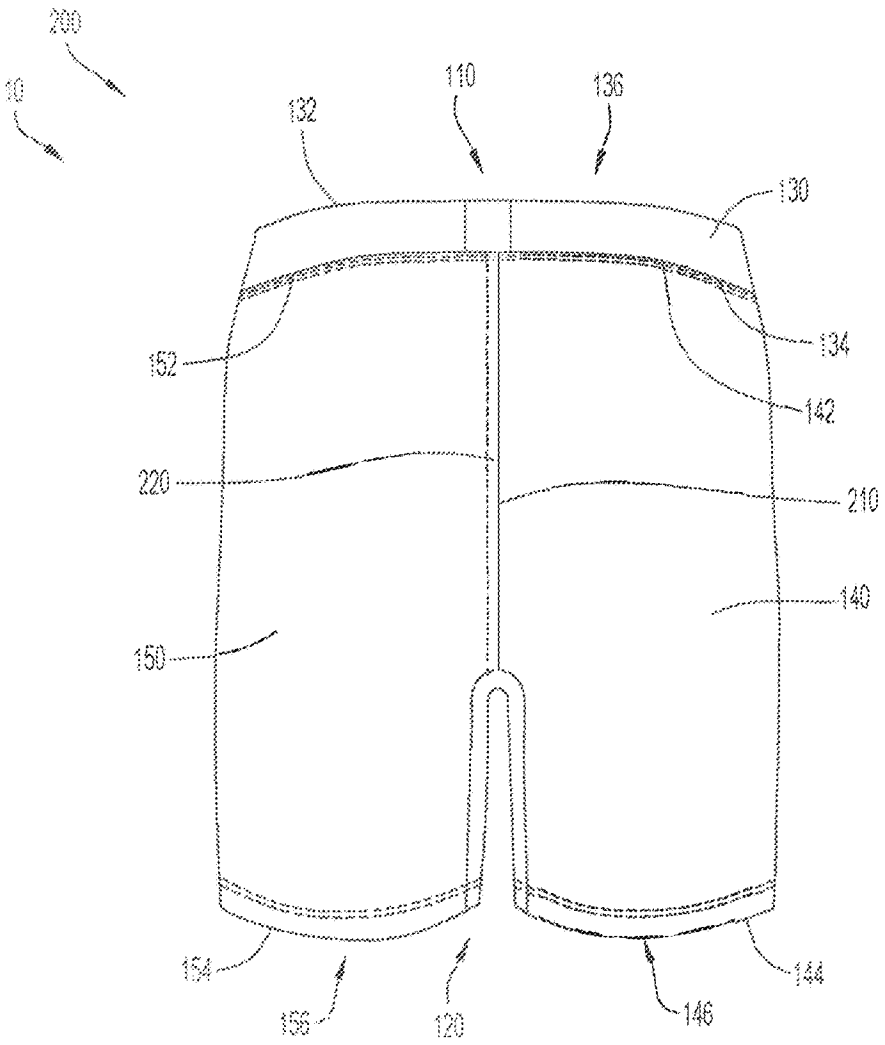
FIG. 2 illustrates a rear view of the embodiment of the garment illustrated in FIG. 1.
Figure 3:
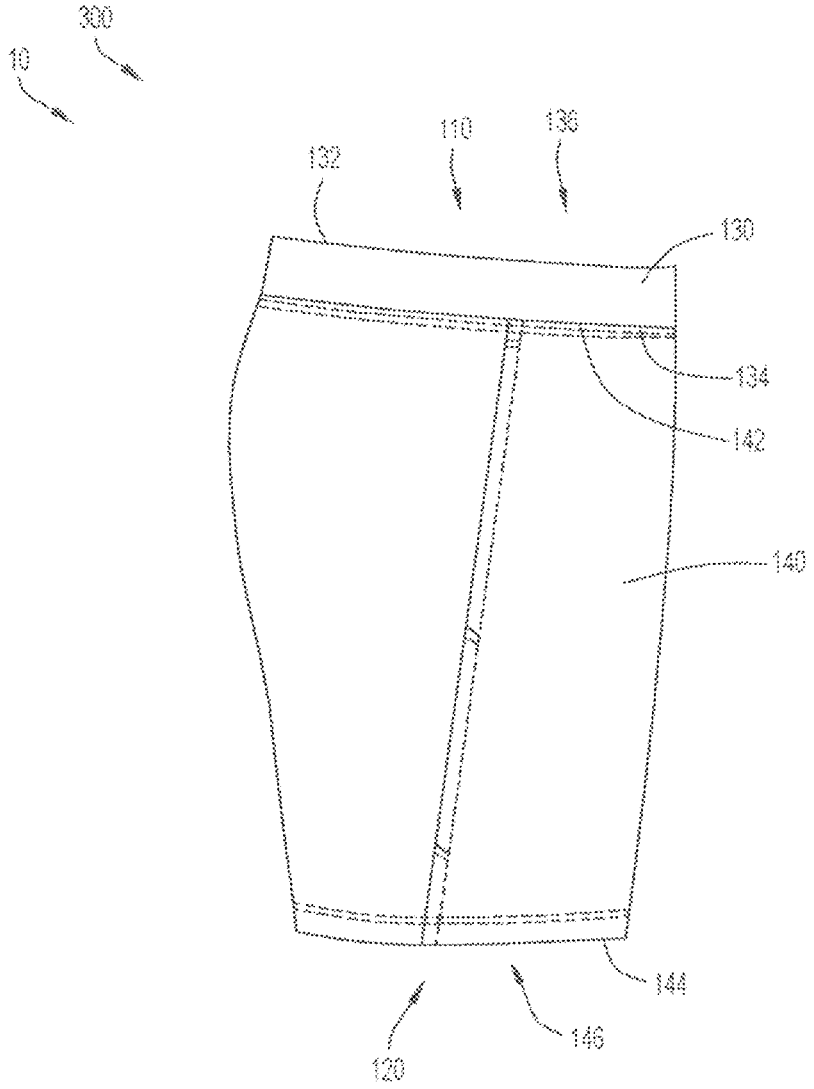
FIG. 3 illustrates a side view of a first side (i.e., right side) of the embodiment of the garment illustrated in FIG. 1.
Figure 4:
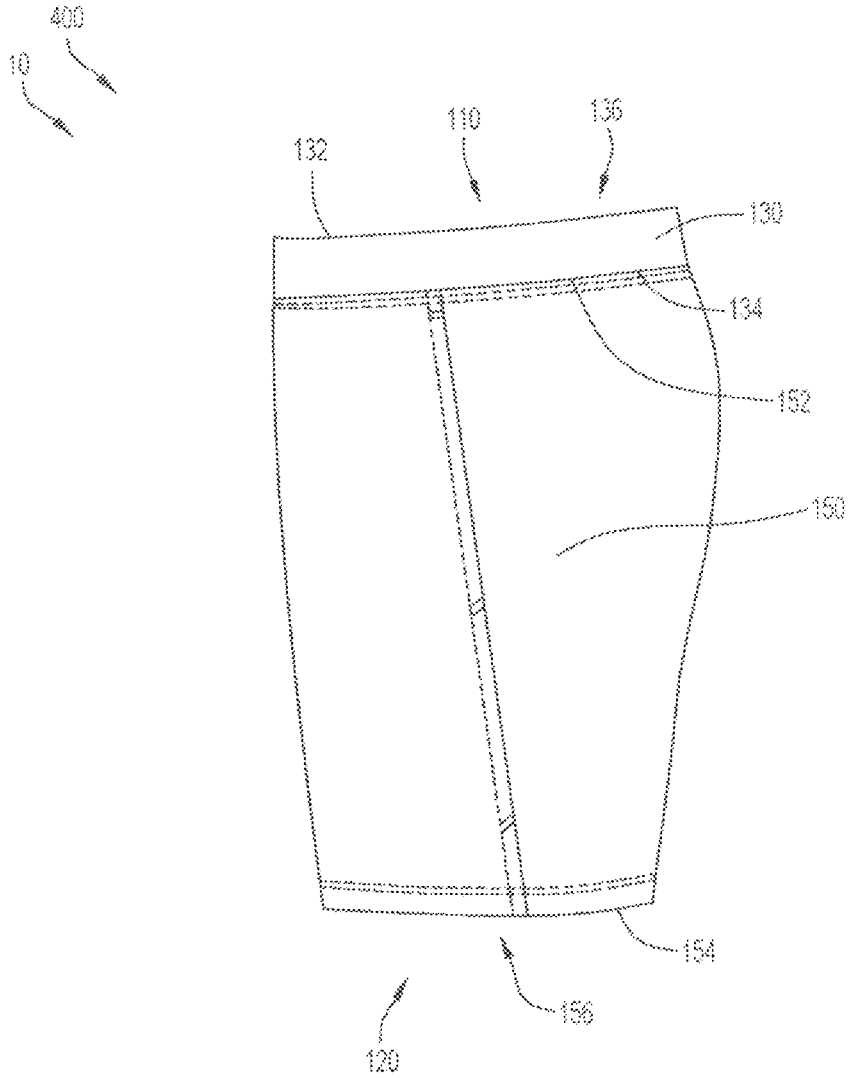
FIG. 4 illustrates a side view of a second side (i.e., left side) the embodiment of the garment illustrated in FIG. 1.

In addition, the first leg portion 140 is disposed proximate to the front side 100, rear side 200, and first side 300 of the pants 10. As illustrated in FIG. 1, the first leg portion 140 includes a top edge 142, a bottom edge 144, and a front edge 148. As illustrated in FIG. 2, the first leg portion 140 also includes a rear edge 210. The first leg portion 140 extends downwardly from the waist portion 130 towards the bottom side 120 of the pants 10, where the top edge 142 of the first leg portion 140 is coupled to a portion of the bottom edge 134 of the waist portion 130. The bottom edge 144 of the first leg portion 140 defines a first leg opening 146 that is configured to receive the first (e.g., right) leg of the user wearing the pants 10. The first leg opening 146 is disposed proximate to the bottom 120 and first side 300 of the pants 10 and surrounds or encircles at least a portion of the first leg (e.g., thigh, knee, calf, ankle, etc.) of the user wearing the pants 10.

Similar to the first leg portion 140, the second leg portion 150 is disposed proximate to the front side 100, rear side 200, and second side 400 of the pants 10. As illustrated in FIG. 1, the second leg portion 150 includes a top edge 152, a bottom edge 154, and a front edge 158. As illustrated in FIG. 2, the second leg portion 150 also includes a rear edge 220. The second leg portion 150 extends downwardly from the waist portion 130 towards the bottom side 120 of the pants 10, where the top edge 152 of the second leg portion 150 is coupled to a portion of the bottom edge 134 of the waist portion 130. The bottom edge 154 of the second leg portion 150 defines a second leg opening 156 that is configured to receive the second (e.g., left) leg of the user wearing the pants 10. The second leg opening 156 is disposed proximate to the bottom 120 and second side 400 of the pants 10 and surrounds or encircles at least a portion of the second leg (e.g., thigh, knee, calf, ankle, etc.) of the user wearing the pants 10. While two leg portions are disclosed in association with the pants of FIG. 1, it will be recognized that only a single leg portion may be included in some embodiments of the pants (e.g., in association with a skirt).

As illustrated in FIG. 1, the first leg portion 140 is coupled to the second leg portion 150 at a central location on the front 100 of the pants 10. More specifically, the front edge 148 of the first leg portion 140, which is vertically oriented, is coupled to the front edge 158 of the second leg portion 150, which is also vertically oriented. Similarly, as best illustrated in FIG. 2, the first leg portion 140 is coupled to the second leg portion 150 by the rear edge 210 of the first leg portion 140 being coupled to the rear edge 220 of the second leg portion 150. Similar to the front edges 148, 158, the rear edges 210, 220 of the first and second leg portion 140, 150 are vertically oriented.

The waist portion 130, first leg portion 140, and second leg portion 150 may be coupled to one another via stitching, such as, but not limited to, flatlock stitching, overlock stitching, blind stitching, etc. In addition, the waist portion 130, first leg portion 140, and second leg portion 150 may be coupled to one another by means other than stitching, such as, but not limited to, bonding, adhesives, etc. In some embodiments, the first leg portion 140 and the second leg portion 150 may be constructed from a woven polyester/stretch blended fabric that contains 86% polyester and 14% elastane, similar to that of the waist portion 130. Thus, the waist portion 130, first leg portion 140, and the second leg portion 150 are at least partially resilient/elastomeric and may be configured to stretch, deform, and take the shape of a portion of the body (e.g., the waist) of the user of the pants 10 when the user is wearing the pants 10.

As further illustrated in FIG. 1, a waist pocket 160 is disposed in or within the waist portion 130 of the pants 10 proximate to the front 100 of the pants 10. The waist pocket 160 may be centrally disposed in the waist portion 130 on the front 100 of the pants so that the waist pocket 160 is disposed equidistant from the first side 300 and the second side 400. The waist pocket 160 is further disposed on the exterior surface 138 of the waist portion 130 such that the waist pocket 160 is exposed and viewable. The waist pocket 160 has a top edge 162, a bottom edge 164, and a front surface 166. The top edge 162 of the waist pocket 160 is aligned with the top edge 132 of the waist portion 130, while the bottom edge 164 of the waist pocket 160 is aligned with the bottom edge 134 of the waist portion 130.

FIGS. 5, 6A, 6B, and 6C illustrate the waist pocket 160 of the embodiment of the pants 10 of FIGS. 1-4. As illustrated in a front view of the waist pocket 160 (e.g., viewing the side or surface of the waist pocket 160 that is on the exterior of the pants 10) in FIG. 5, the waist pocket 160 includes a first, or outer, flap 500 and a second, or inner, flap 510. The first flap 500 may include a top edge 502 and bottom edge 504. The top edge 502 may be disposed proximate to the top edge 132 of the waist portion 130 of the pants 10 such that the top edge 502 of the waist pocket 160 aligns with and/or is fixedly coupled to the top edge 132 of the waist portion 130 of the pants 10. In other words, the top edge 502 of the first flap 500 of the waist pocket 160 may form the portion of the top edge 132 of the waist portion 130 at the location where the waist pocket 160 is disposed on the waist portion 130. The bottom edge 504 may be disposed opposite of the top edge 502 such that the bottom edge 504 is disposed more proximate to the bottom edge 134 of the waist portion 130 than to the top edge 132 of the waist portion 130 of the pants 10. In addition, the sides 506, 508 of the first flap 500 may be fixedly coupled to the waist portion 130. As illustrated, the bottom edge 504 of the first flap 500 may be arcuate, or, in other words, contains a curvature 509. In other embodiments, the bottom edge 504 of the first flap 500 may include a quarter inch encased elastic with a gathering that is undercut so that, when manipulated, the bottom edge 504 of the first flap 500 returns to its position proximate to the bottom edge 164 of the waist pocket 160.

Figure 5:
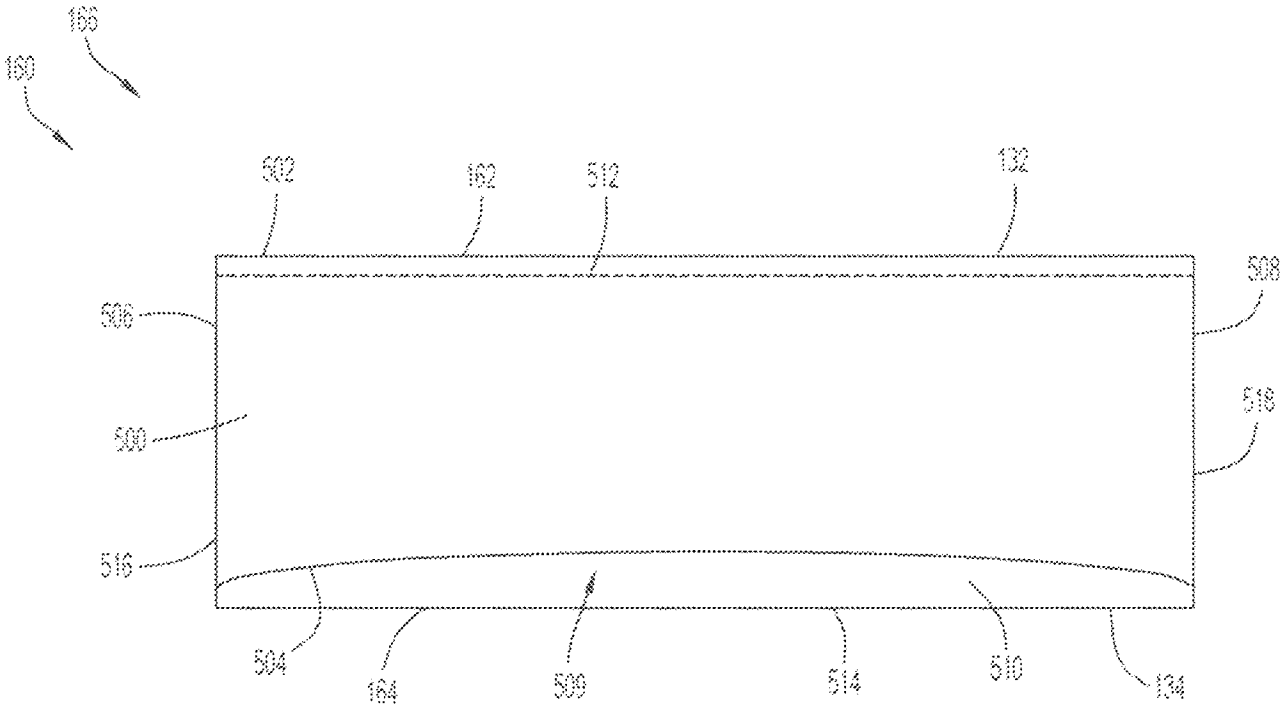
FIG. 5 illustrates a schematic view of the front side of the pocket of the embodiment of the garment illustrated in FIG. 1.

As best illustrated in FIG. 5, the second flap 510 includes a top edge 512 and a bottom edge 514. The top edge 512 of the second flap 510, shown in phantom in FIG. 5, may be disposed proximate to the top edge 132 of the waist portion 130 of the pants 10 and the top edge 502 of the first flap 500. As illustrated, the top edge 512 of the second flap 510 may be disposed underneath the first flap 500. Thus, the first flap 500 at least partially lies overtop the second flap 510 such that the top edge 512 of the second flap 510 is covered by the first flap 500. The second flap 510 further includes a bottom edge 514 opposite of the top edge 512, where the bottom edge 514 may be exposed and fixedly coupled to the bottom edge 134 of the waist portion 130, such that the bottom edge 514 appears to be aligned with the bottom edge 134 of the waist portion 130. In other words, the bottom edge 514 of the second flap 510 of the waist pocket 160 may form the portion of the bottom edge 134 of the waist portion 130 at the location where the waist pocket 160 is disposed on the waist portion 130. Thus, by the positioning of the waist pocket 160 illustrated in FIG. 1, the second flap 510 may also be fixedly coupled to the top edge 142 of the first leg portion 140 and the top edge 152 of the second leg portion 150. Similar to the first flap 500, the second flap 510 may also include sides 516, 518 that may be fixedly coupled to the waist portion 130. In addition, the sides 516, 518 of the second flap 510 may be fixedly coupled to the sides 506, 508 of the first flap 500. While the schematic drawing of FIG. 5 illustrates that the waist pocket 160 is substantially rectangular, in other embodiments of the waist pocket, the sides of the waist pocket formed by sides 506, 508 of the first flap 500 and sides 516, 518 of the second flap 510 may be angled to form a substantially trapezoidal waist pocket 160.

The first flap 500 and the second flap 510 may be constructed from a 100% polyester fabric, or, because the first flap 500 and the second flap 510 from a portion of the waist pocket 160, which is inline with the waist portion 130, the first flap 500 and the second flap may be constructed from a blended fabric of polyester and elastane (e.g., 86% polyester and 14% elastane). Thus, the flaps 500, 510 may be either non-resilient, where the flaps 500, 510 are not configured to stretch, or the flaps 500, 510 may be constructed to be resilient/elastomeric, where the flaps 500, 510 are configured to stretch and deform. In the embodiment of the pants 10 where the flaps 500, 510 are not resilient, at least the bottom edge 502 of the first flap may contain an elastomeric member with an undercut length, as explained previously, to return the bottom edge 504 of the first flap 500 to its position proximate to the bottom edge 164 of the waist pocket 160 after manipulation. In the embodiment of the pants 10, where the flaps 500, 510 are configured to be resilient, the flaps 500, 510 are configured to stretch and deform with the waist portion 130.

Figure 6A:
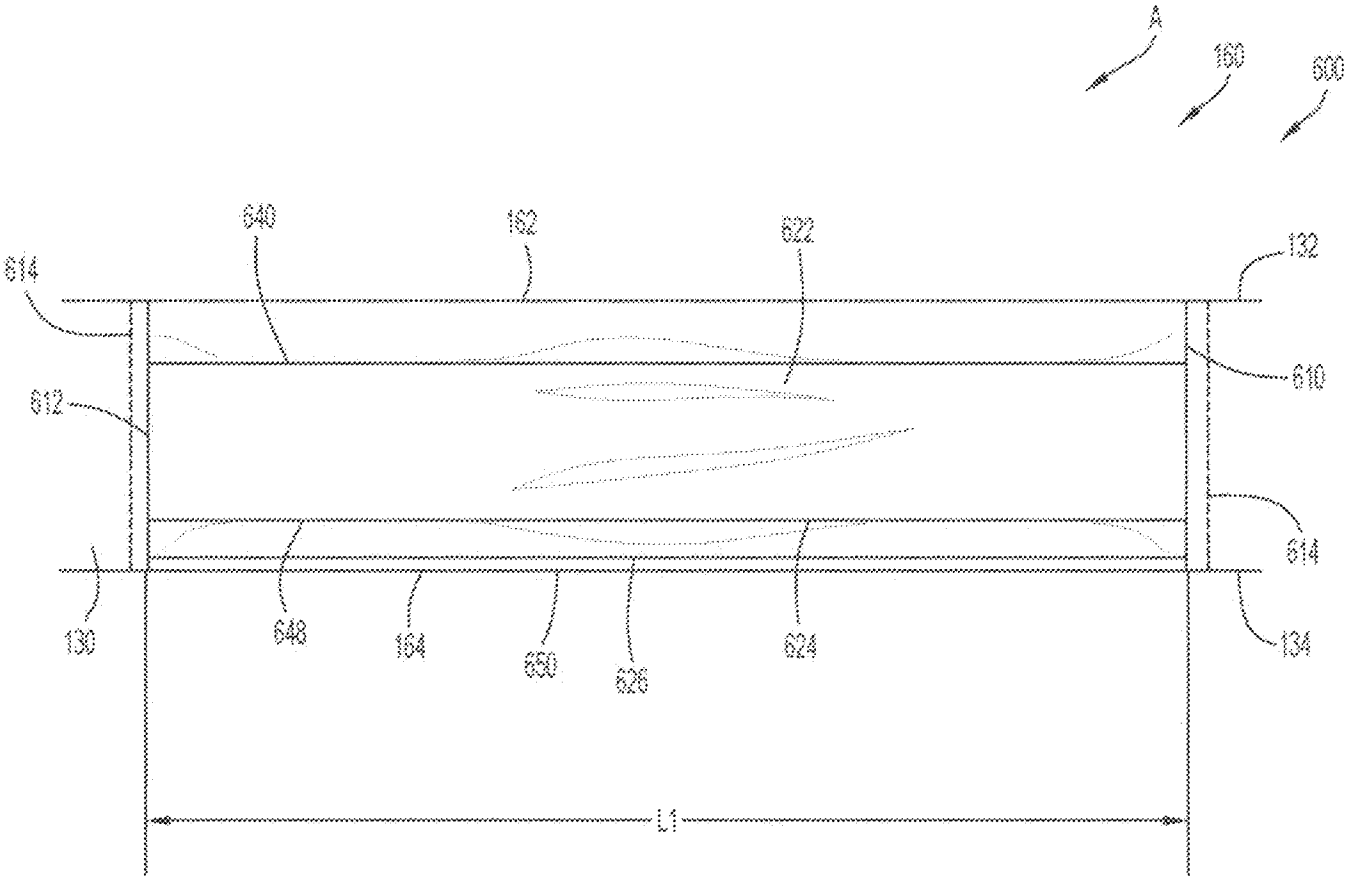
FIG. 6A illustrates a schematic view of the rear side of the pocket of the embodiment of the garment illustrated in FIG. 1, the pocket being in the empty configuration.
Figure 6B:
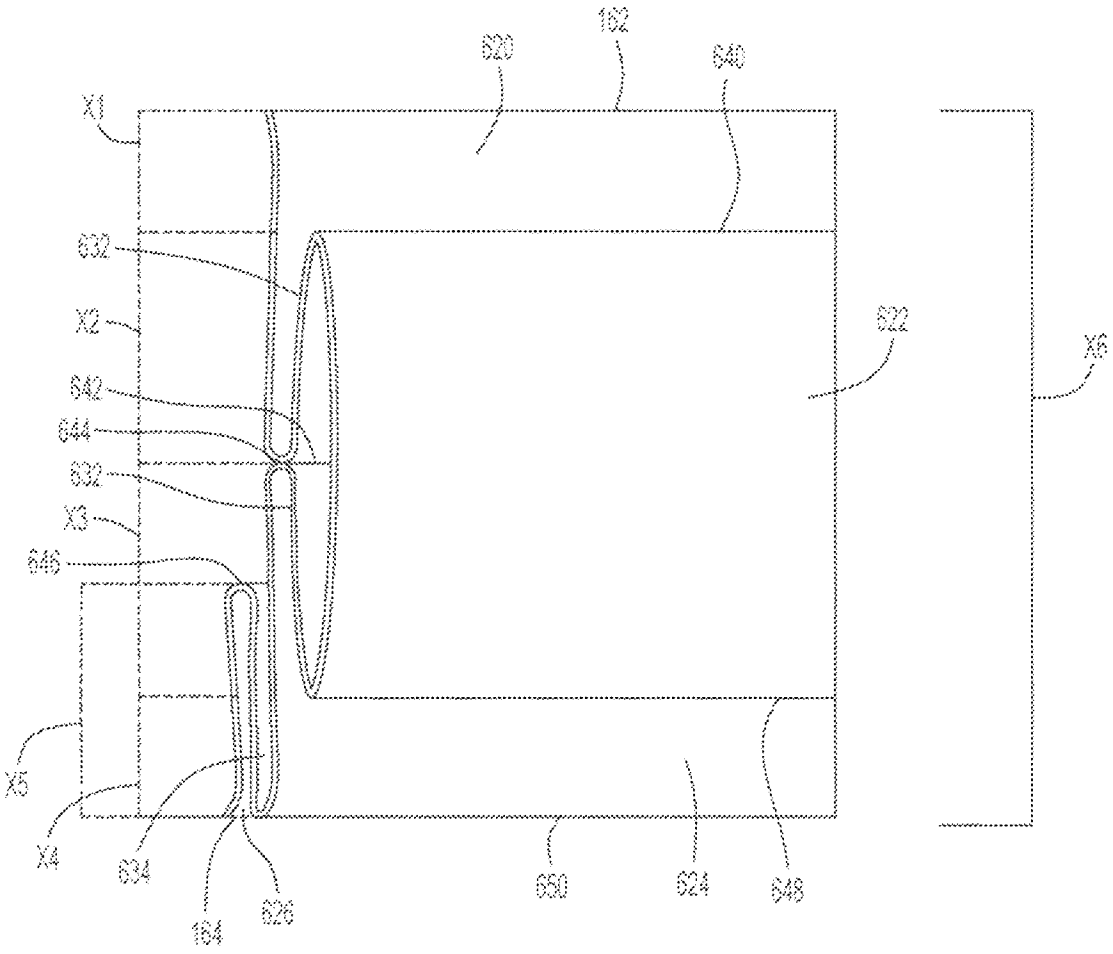
FIG. 6B illustrates a detailed view of the folds and panels of the pocket of the embodiment of the garment illustrated in FIG. 1 when the pocket is in the empty configuration.

FIGS. 6A and 6B illustrate that a rear view of the waist pocket 160 (e.g., viewing the side or surface of the waist pocket 160 that faces the interior of the pants 10) shows the various fold lines of the waist pocket 160. As illustrated, the rear side 600 of the waist pocket 160 includes a first side 610 and a second side 612 opposite the first side 610. The first and second sides 610, 612 are coupled to the waist portion 130 of the pants 10. Both the first side 610 and the second side 612 are coupled to the waist portion 130 of the pants 10 via stitching 614. The first and second sides 610, 612 may be coupled to the waist portion 130 via other means, such as, but not limited to, adhesives, tape, bonding, etc.

Figure 6C:
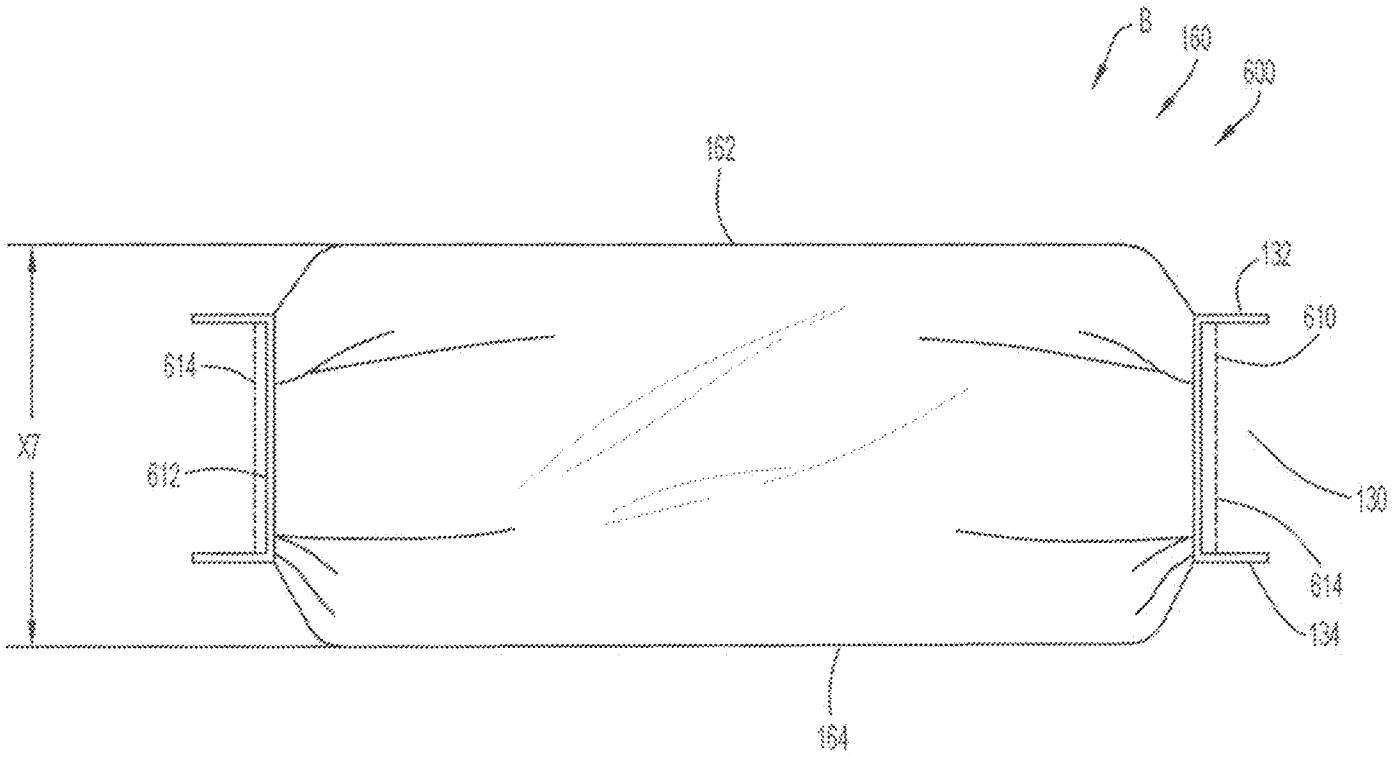
FIG. 6C illustrates a schematic view of the rear side of the pocket of the embodiment of the garment illustrated in FIG. 1, the pocket being in the expanded configuration.

The waist pocket 160 illustrated in FIGS. 6A and 6B is in a first or empty configuration A, while the waist portion 160 illustrated in FIG. 6C is in a second or expanded configuration B. As best illustrated in FIG. 6B, when in the empty configuration A, the rear side 600 of the waist pocket 160 contains four sections facing a first, or interior, direction (these sections face towards the interior of the pants 10): first section 620, second section 622, third section 624, and fourth section 626. The rear side 600 of the waist pocket 160 also contains three sections facing a second, or exterior direction (these sections face towards the exterior of the pants 10): fifth section 630, sixth section 632, and seventh section 634. Each of the sections 620, 622, 624, 626, 630, 632, 634 are separated by a plurality of fold lines 640, 642, 644, 646, 648, 650. As illustrated, the first section 620 is defined by the top edge 162 of the waist pocket 160 and the second fold line 642. The fifth section 630 is defined by the second fold line 642 and the first fold line 640. The second section 622 is defined by the first fold line 640 and the fifth fold line 648. The sixth section 632 is defined by the fifth fold line 648 and the third fold line 644. The third section 624 is defined by the third fold line 644 and the sixth fold line 650. The seventh section 634 is defined by the sixth fold line 650 and the fourth fold line 646. Finally, the fourth section 626 is defined by the fourth fold line 646 and the bottom edge 164 of the waist portion 160.

As further illustrated in FIG. 6B, when the waist portion 160 is in the empty configuration A, the fifth, sixth, and seventh sections 630, 632, 634 are not exposed. Furthermore, the second section 622 is fully exposed, while the first and third sections 620, 624 are at least partially exposed. The fourth section 626 may be at least partially exposed (as shown by the small exposed portion illustrated in FIG. 6A proximate to the bottom edge 164 of the waist pocket 160), or may not be exposed. As further illustrated, the fifth section 630 faces the first section 620, the sixth section 632 faces the third section 624, and the seventh section 634 faces the fourth section 624. The fifth section 630 and at least a portion of the second section 622 cover at least a portion of the first section 620, and leaves a portion of the first section 620 exposed. Similarly, the sixth section 632 and at least a portion of the second section 622 cover at least a portion of the third section 624, and leaves a portion of the third section 624 exposed.

Furthermore, as best illustrated in FIG. 6A, the total length of the waist pocket 160, or the distance between the first side 610 and the second side 612, is represented by L1. The sections 620, 622, 624, 626, 630, 632, 634 and the fold lines 640, 642, 644, 646, 648, 650 span the distance L1 across the waist pocket 160. The sections 620, 622, 624, 626, 630, 632, 634 and the fold lines 640, 642, 644, 646, 648, 650, moreover, are also bound or coupled to the waist portion 130 via stitching 614. Because the sections 620, 622, 624, 626, 630, 632, 634 and the fold lines 640, 642, 644, 646, 648, 650 are bound by stitching 614, when the waist pocket 160 returns to the empty configuration A from the expanded configuration B, the sections 620, 622, 624, 626, 630, 632, 634 and the fold lines 640, 642, 644, 646, 648, 650 are reformed and take shape.

As best illustrated in FIG. 6B, the first section 620 has a height of the combination of X1 and X2, where X2 is the height of the fifth section 630 and X1 is the height of the exposed portion of the first section 620. In some embodiments, X1 and X2 may be equal to one another, while in other embodiments X2 may be larger than X1, or X1 may be larger than X2. Furthermore, the sixth section 632 may have a height of X3, where X3 may be equal to X2, or may be smaller or larger than X2. The second section 622 may have a height of the combination of heights X2 and X3. Additionally, the third section has a height of the combination of heights X3 and X4, where X4 is the height of the exposed portion of the third section 624. The fourth section 624 and the seventh section 634 have a height of X5. As further illustrated, the total height of the waist pocket 160 is X6, which is the combination of heights X1, X2, X3, and X4. Because, as previously explained and as illustrated in FIG. 6A, the top edge 162 of the waist pocket 160 is aligned with the top edge 132 of the waist portion 130, and the bottom edge 164 of the waist pocket 160 is aligned with the bottom edge 134 of the waist portion 130, the height of the waist portion 130 may also be equal to the height of waist pocket 160, which is represented by X6.

In one embodiment, X1 may be equal to 0.25 inches, and X2 may be equal to 0.5 inches. Similarly, X3 may be equal to 0.5 inches and X4 may be equal to 0.25 inches. Thus, because the second section 622 has a height equal to the combination of heights X2 and X3, the height of the second section 622 may be approximately 1 inch. As further illustrated, X5 may be equal to 0.5 inches, and the total height X6 of the waist pocket 160 may be approximately 4.5 inches. The length L1 between the first side 610 and the second side 612 may be equal to 7.25 inches.

As previously explained, the waist pocket 160 in the expanded configuration B is illustrated in FIG. 6C. The waist pocket 160 is reconfigured from the empty configuration A to the expanded configuration B when an item or items (e.g., mobile phone, wallet, credit card, keys, etc.) are placed within the waist pocket 160. As illustrated, when items are placed within the waist pocket 160, the pocket 160 is expanded in the vertical direction such that the distance between the top edge 162 and the bottom edge 164 increases from the height of X6 illustrated in FIG. 6B to the height of X7 illustrated in FIG. 6C while the height of the waist portion 130 remains the same at a height of X6. Thus, the height X7 is greater than the height X6. With the height X7 being larger in the expanded configuration B than the height X6 in the empty configuration A, the top edge 162 of the waist pocket 160 no longer aligns with the top edge 132 of the waist portion 130. Furthermore, the bottom edge 164 of the waist pocket 160 no longer aligns with the bottom edge 134 of the waist portion 130 when the pocket 160 is in the expanded configuration B. As illustrated, the top edge 162 of the waist pocket 160 is disposed above the top edge 132 of the waist portion 130, while the bottom edge 164 of the waist pocket 160 is disposed lower than the bottom edge 134 of the waist portion 130. Additionally, when the waist pocket 160 is in the expanded configuration B, the rear side 600 may no longer contain the plurality of sections 620, 622, 624, 626, 630, 632, 634 and the plurality of fold lines 640, 642, 644, 646, 648, 650. The size of the object placed within the pocket 160 dictates the height X7 of the pocket 160 in the expanded configuration, and also dictates how many of the plurality of sections 620, 622, 624, 626, 630, 632, 634 and plurality of fold lines 640, 642, 644, 646, 648, 650 that are no longer present.

In one embodiment, the rear side 600 of the waist pocket 160 may be constructed from a polyester blended fabric. Thus, the rear side 600, with the plurality of sections 620, 622, 624, 626, 630, 632, 634 and the plurality of fold lines 640, 642, 644, 646, 648, 650, may be constructed from a fabric that is 90% polyester and 10% elastane. This embodiment of the rear side 600 of the waist pocket 160 may have a slightly less resilient structure than that of the waist portion 130 and front flaps 500, 510 of the pocket 160. This construction, however, provides the rear side 600 with a degree of resiliency that enables the rear side 600 to stretch into the expanded configuration B when an object is placed within the interior of the waist pocket 160, and return to the empty configuration A, where the rear side 600 reforms the plurality of sections 620, 622, 624, 626, 630, 632, 634 and the plurality of fold lines 640, 642, 644, 646, 648, 650. In addition, because the rear side 600 of the waist pocket 160 is facing the interior of the pants 10, when the pants 10 are worn by a user, the rear side 600 may abut or contact the user. Thus, the rear side 600 may include anti-microbial/moisture wicking properties to prevent sweat from the user's body coming in contact with the objects placed within the waist pocket 160.

In order to place an object within the waist pocket 160 of the embodiment of the pants 10 illustrated in FIGS. 1-5, 6A, 6B, and 6C, the user must separate the first flap 500 from the second flap 520 to gain access to the interior of the waist pocket 160. In the closed position, illustrated in FIGS. 1 and 5, the first flap 500 lies at least partially over the second flap 510, such that the interior surface of the first flap 500 abuts against, contacts, or is adjacent to the exterior surface of the second flap 510. Additionally, when in the closed position, the bottom edge 504 of the first flap 500 is oriented lower than the top edge 512 of the second flap 510, such that the first flap 500 covers the top edge 512 of the second flap 500. In other words, in the closed position, the top edge 512 of the second flap 500 is oriented closer to the top edge 162 of the waist pocket 160 than the bottom edge 504 of the first flap 500, which overlies the second flap 510. When a user manipulates the waist pocket 160 to place objects within the waist pocket 160, the first flap 500 is at least partially pulled away from the second flap 510, such that at least a portion of the interior surface of the first flap 500 is disposed or spaced away from the exterior surface of the second flap 510. Thus, when opening the waist pocket 160, at least a portion of the interior surface of the first flap 500 is oriented farther away from the exterior surface of the second flap 510 than when in the waist pocket 160 is in the closed position.

Once the first flap 500 is oriented away from the second flap 510, an opening may be created by the first flap 500 and the second flap 510. This opening provides access to the top edge 512 of the second flap 500, which can be pulled downward to access the interior of the waist pocket 160. The bottom edge 504 of the first flap 500 may be pulled closer to the top edge 162 of the waist pocket 160, while the top edge 512 of the second flap 510 may be pulled downward, away from the top edge 162 of the waist pocket 160. Thus, the top edge 512 of the second flap 500 may be at least partially exposed, such that the first flap 500 does not cover or overlie the entire top edge 512 of the second flap 510. By pulling the top edge 512 of the second flap 500 downward and the bottom edge 504 of the first flap 500 upward, access is provided to the interior of the waist pocket 160.

An object or item (i.e., mobile phone) may then be slipped or forced between the interior surface of the first flap 500 and the exterior surface of the second flap 510 such that the object moves past the bottom edge 504 of the first flap 500 and the top edge 512 of the second flap 500, and into the interior of the waist pocket 160. When an object is positioned within the interior of the waist pocket 160, the waist pocket 160 is reconfigured from the empty configuration A, illustrated in FIGS. 6A and 6B, to the expanded configuration B, illustrated in FIG. 6C. The waist pocket 160 expands to the expanded configuration B to accommodate object(s) that may be larger in width and/or depth than the waist pocket 160 in the empty configuration A. After the object has been secured within the waist pocket 160, the first flap 500 and the second flap 510 return to their closed position, where the first flap 500 lies at least partially over the second flap 510, such that the interior surface of the first flap 500 abuts against the exterior surface of the second flap 510. Furthermore, the bottom edge 504 of the first flap 500 is oriented lower than the top edge 512 of the second flap 510, such that the first flap 500 covers the top edge 512 of the second flap 500.

As best illustrated in FIG. 5, the waist pocket 160 is substantially equivalent to the size and shape of the second flap 510. The waist pocket 160 is defined by and disposed between the first and second flaps 500, 510, the rear side 600 of the waist pocket 160, and the sides 610, 612 of the waist portion 160. The sides 610, 612 of the waist pocket 160 are substantially vertical, making the waist pocket 160 substantially rectangular. In other embodiments of the waist pocket 160, however, these sides 610, 612 may be angled or curved to give the waist pocket 160 another shape.

Garment with Interior Waist Pocket

Figure 7:
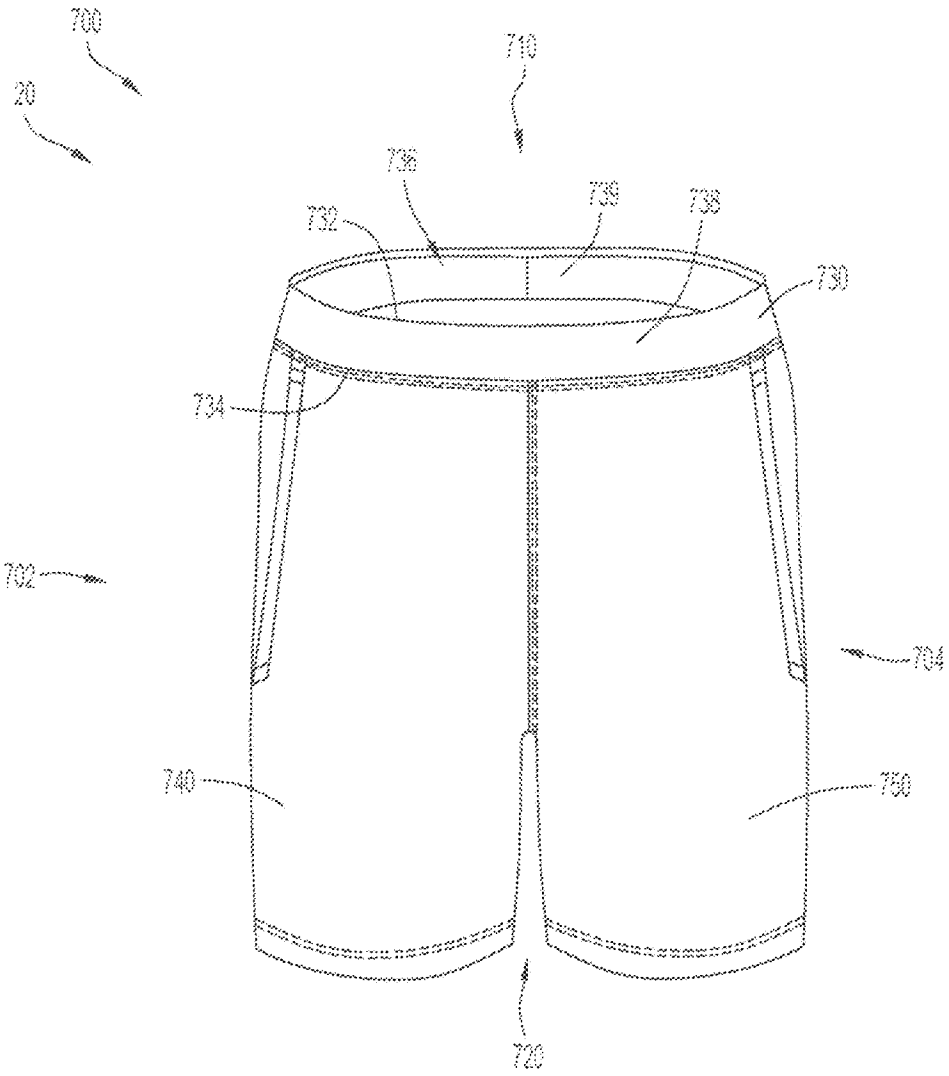
FIG. 7 illustrates a front view of a garment in accordance with a second embodiment of the present invention.

FIGS. 7, 8A, 8B, 9A, 9B, 10, 11A, 11B, 12A, and 12B illustrate a second embodiment of a garment or pants that can be worn by a person, where the garment includes a pocket in the waistband of the garment. Similar to the first embodiment of the pants 10, the second embodiment of the pants 20 include a front side 700, and a rear side oriented opposite of the front side 700, a first (e.g., right) side 702 connecting the front side 700 to the rear side, and a second (e.g., left) side 704 that is oriented opposite of the first side 702 and also connects the front side 700 to the rear side. The second embodiment of the pants 20 further include a top side 710 and a bottom side 720 oriented opposite of the top side 710. Also similar to the first embodiment of the pants 10, the second embodiment of the pants 20 may contain a waist portion 730, a first leg portion 740 extending downwardly from the waist portion 730 proximate the first side 702, and a second leg portion 750 extending downwardly from the waist portion 730 proximate the second side 702. As illustrated in FIG. 7, the waist portion or waistband 730 is disposed proximate to the top 710 of the pants 20 and includes a top edge 732 and a bottom edge 734. The waist portion 730 defines opening 736 proximate to the top side 710 of the pants 20. Opening 736, similar to opening 136 of the first embodiment of the pants 10, is configured to receive portions of the body of the user wearing the pants 20. The waist portion 730 further includes an exterior surface 738 and an interior surface 739, where the interior surface 739 of the waist portion 730 contacts the portion of the body that the waist portion encircles. As best illustrated in FIG. 7, the second embodiment of the pants 20 differs from the first embodiment of the pants 10 in that the pocket 160 of the first embodiment of the pants 10 is disposed at least partially on the exterior surface 138 of the waist portion 130 such that the waist pocket 160 is visible, while the waist pocket of the second embodiment of the pants 20 is not visible when viewing the exterior surface 738 of the waist portion 730.

Figure 8A:
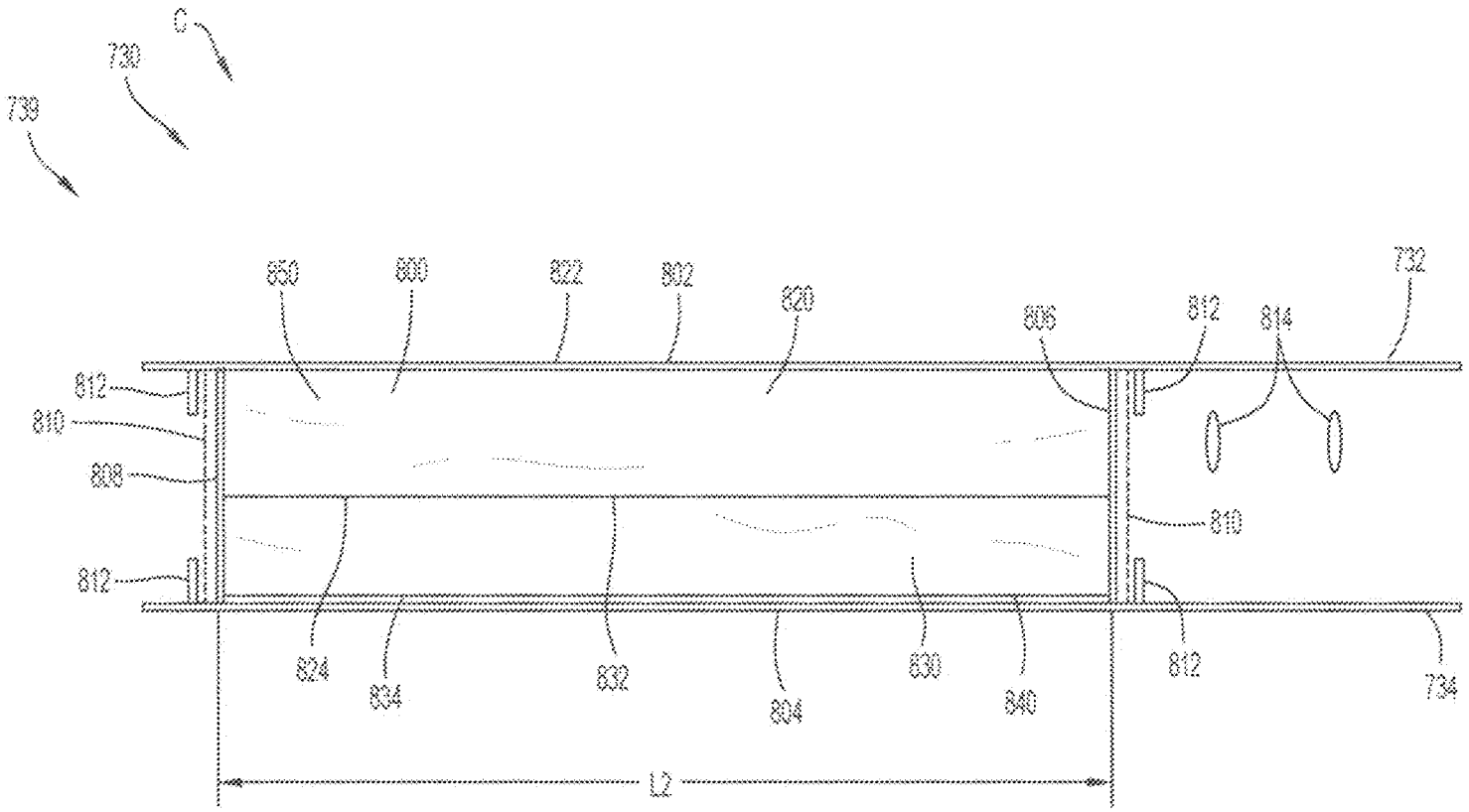
FIG. 8A illustrates a schematic view of the inner side of the pocket of the embodiment of the garment illustrated in FIG. 7, the pocket being in the empty configuration.
Figure 8B:
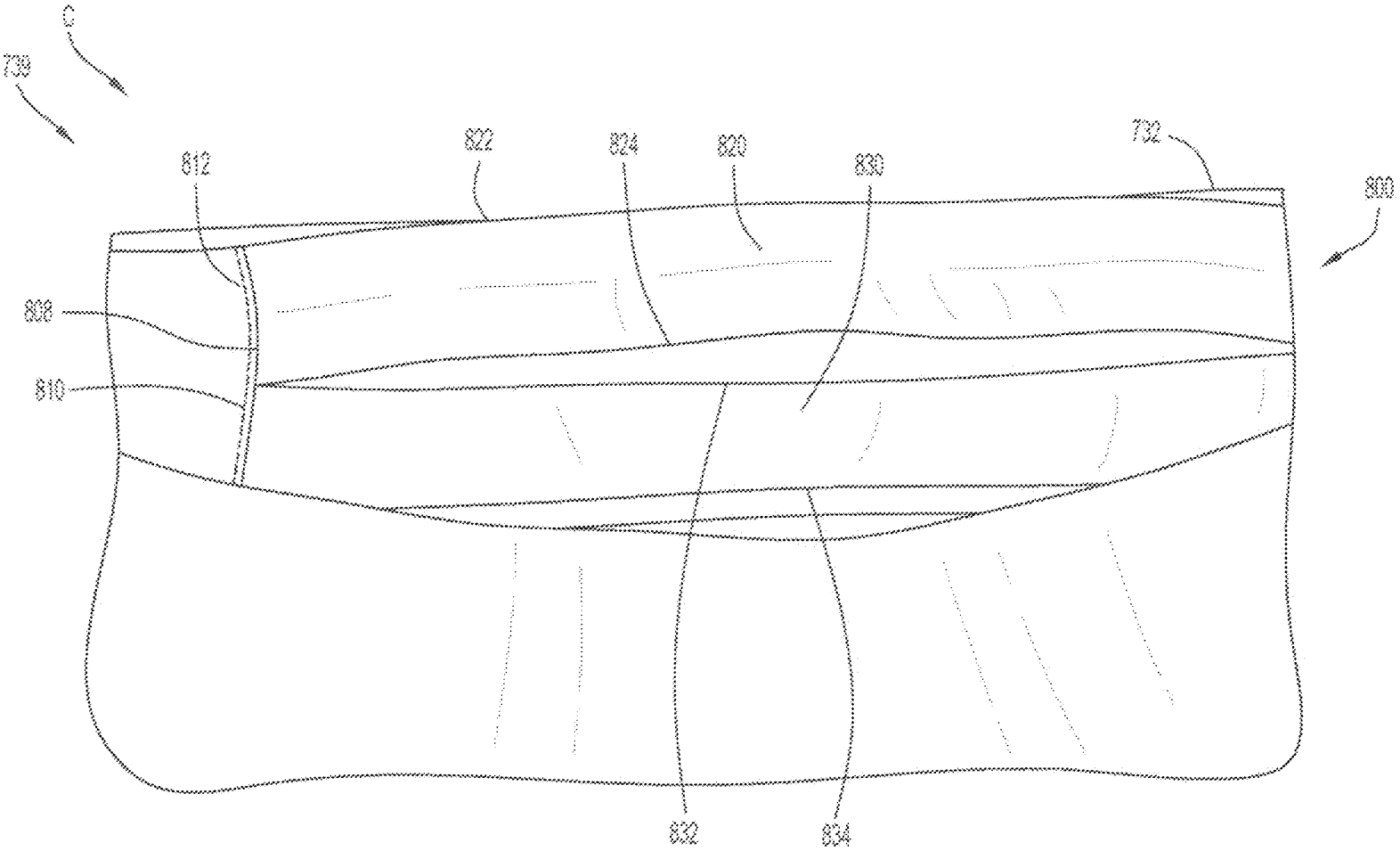
FIG. 8B illustrates an interior view of the embodiment of the garment illustrated in FIG. 7, and illustrates the pocket in the empty configuration.

Instead, as best illustrated in FIGS. 8A and 8B, the waist pocket 800 of the second embodiment of the pants 20 is disposed on the interior surface 739 of the waist portion 730. The waist pocket 800 may be disposed centrally on the interior surface 739 of the front side 700 of the waist portion 730 of the pants 20. The waist pocket 800 illustrated in FIGS. 8A and 8B is in the first or empty configuration C. The waist pocket 800 includes a top edge 802, a bottom edge 804 opposite the top edge 802, a first side 806 proximate the first side 702 of the pants 20, and a second side 808 proximate the second side 704 of the pants 20. The total length of the waist pocket 800, or the distance between the first side 806 and the second side 808, is represented by L2. As illustrated in FIGS. 8A and 8B, the top edge 802 of the waist pocket 800 is disposed proximately to, and aligned with, the top edge 732 of the waist portion 730. Similarly, the bottom edge 804 of the waist pocket 800 is disposed proximate to, and aligned with, the bottom edge 734 of the waist portion 730. The first side 806 and the second side 808 are coupled to the waist portion 130 of the pants 10 via stitching 810 and/or bar tacks 812. The stitching 810 and the bar tacks 812 may not be visible from the exterior surface 738 of the waist portion 730. In other embodiments, the first and second sides 806, 808 may be coupled to the waist portion 730 via other means, such as, but not limited to, adhesives, tape, bonding, etc.

As further illustrated in FIG. 8A, proximate to the first side 806 of the pocket 800, the interior surface 739 of the waist portion 730 includes a set of bar tacks 814 that define openings through which a drawstring may be threaded. Typical athletic shorts contain a drawstring that extends centrally from the interior surface of the waist portion, where the drawstrings are operable to tighten the waist portion. However, when the pocket 800 is centrally disposed on the interior surface 739 of the waist portion 730 of the pants 20, the drawstrings extending from the interior surface 739 of the waist portion 730 may be shifted towards the first side 702 or the second side 704. Thus, as FIG. 8A illustrates, the set of bar tacks 814 proximate to the first side 806 of the pocket 800 define openings that enable a drawstring to be threaded through the openings, where a drawstring extending from the bar tacks 814 may be used to tighten the waist portion 730 of the pants 20.

The embodiment of the pocket 800 illustrated in FIGS. 8A and 8B includes a backing sheet 850 that contains three exposed panels 820, 830, and 840 when in the empty configuration C. First exposed panel 820 includes a top edge 822 and a bottom edge 824. Second exposed panel 830 also includes a top edge 832 and a bottom edge 834. As illustrated, the bottom edge 824 of the first exposed panel 820 may be disposed proximate to, and aligned with, the top edge 832 of the second exposed panel 830. However, FIG. 8B illustrates the bottom edge 824 of the first exposed panel 820 slightly separated from the top edge 832 of the second exposed panel 830, revealing other panels of the pocket 800. As further illustrated, the top edge 822 of the first exposed panel 820 may be aligned with the top edge 802 of the pocket 800, and thus the top edge 732 of the waist portion 730, because the top edge 822 of the first exposed panel 820 may also form, as further explained below, the top edge 802 of the pocket 800 when the pocket is in the empty configuration C. In addition, as best illustrated in the schematic illustration of FIG. 8A, the bottom edge 834 of the second exposed portion 830 may be disposed proximate to the bottom edge 804 of the pocket 800, but is disposed far enough away from the bottom edge 804 of the pocket 800 to at least partially expose third exposed panel 840.

Figure 9A:
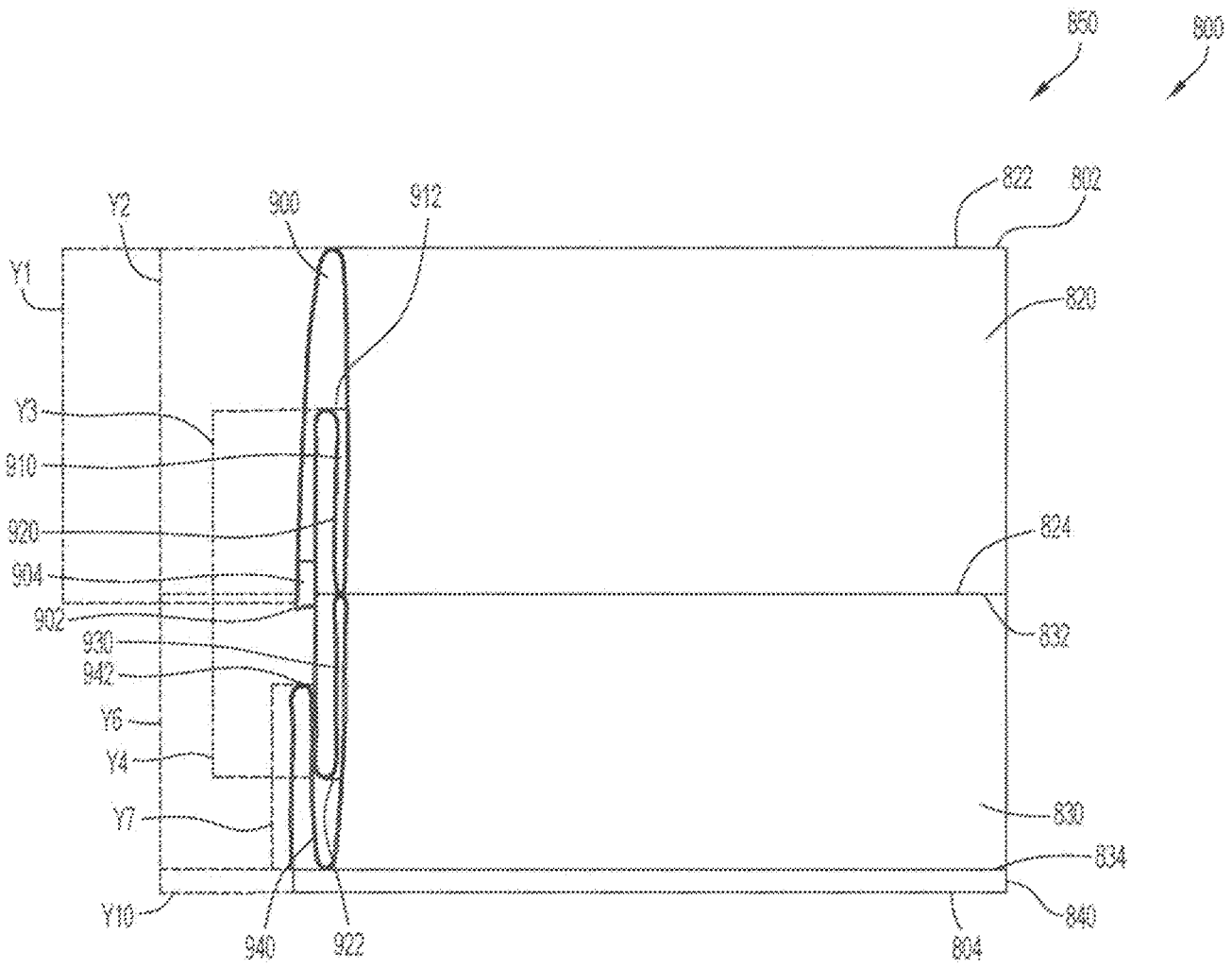
FIG. 9A illustrates a detailed view of the folds and panels of the pocket of the embodiment of the garment illustrated in FIG. 7 when the pocket is in the empty configuration.

As illustrated in FIG. 9A, the backing sheet 850 of the pocket 800 includes a plurality of exposed or partially exposed panels 820, 830, 840, and a plurality of unexposed panels 900, 910, 920, 930, 940. The exposed panels 820, 830, 840 are exposed when viewing the interior surface 739 of the waist portion 730. As previously explained, the first exposed surface 820 includes a top edge, or top fold line, 822, and a bottom edge, or bottom fold line, 824. Thus, first exposed surface 820 is defined by the top edge 822 and the bottom edge 824. The first unexposed panel 900 is defined by bottom edge 902 and top edge 822, and is covered by, or layered behind, the first exposed panel 820. Thus, when the pocket 800 is in the empty configuration C, the first unexposed panel 900 is disposed within the interior of the pocket 800. The bottom edge 902 of the first unexposed panel 900 may include a binding 904 that may encase elastic is undercut so that, when manipulated, the binding 904 and bottom edge 902 of the unexposed panel 900 may return to its position within the interior of the waist pocket 800. The top edge 822 may form the top edge 802 of the pocket 800, where the first exposed panel 820 on one side of the top edge 822 is disposed on the exterior surface of the pocket 800 and the first unexposed panel 900 on the opposite side of the top edge 822 is disposed within the interior of the pocket 800 between the waist portion 730 and the first exposed panel 820.

As further illustrated in FIG. 9A, the second unexposed panel 910 may be defined by a first interior fold line 912 and bottom edge 824 of the first exposed panel 820. Thus, as illustrated, the second unexposed panel 910 is covered by, or layered behind, the first exposed panel 820. The third unexposed panel 920 may be defined by the first interior fold line 912 and the second interior fold line 922. In addition, the fourth unexposed panel 930 may be defined by the second interior fold line 922 and the top edge 832 of the second expose panel 830, while, as previously explained, the second exposed panel 830 may be defined by the top edge 832 and the bottom edge 834. Thus, as illustrated, the fourth unexposed panel 930 is covered by, or layered behind, the second exposed panel 830. The third unexposed panel 920 may be located, or layered, behind both the second and fourth unexposed panels 910, 930 and the first and second exposed panels 820, 830. If the bottom edge 824 of the first exposed panel 820 separates from the top edge 832 of the second exposed panel 830, the third unexposed panel 920 may be at least partially exposed, as illustrated in FIG. 8B.

The fifth unexposed panel 940 may be defined by the bottom edge 834 of the second exposed panel 830 and the third interior fold line 942. As illustrated, the fifth unexposed panel 940 may be layered behind, and covered by, the second exposed panel 830, and may be at least partially layered behind the fourth unexposed panel 930. Finally, the third exposed panel 830 may be defined by the third interior fold line 942 and the bottom edge 804. As illustrated in FIGS. 8A and 9A, the third exposed panel 830 may be partially exposed with a portion of the third exposed panel 830 being layered behind the second exposed panel 830.

Figure 9B:
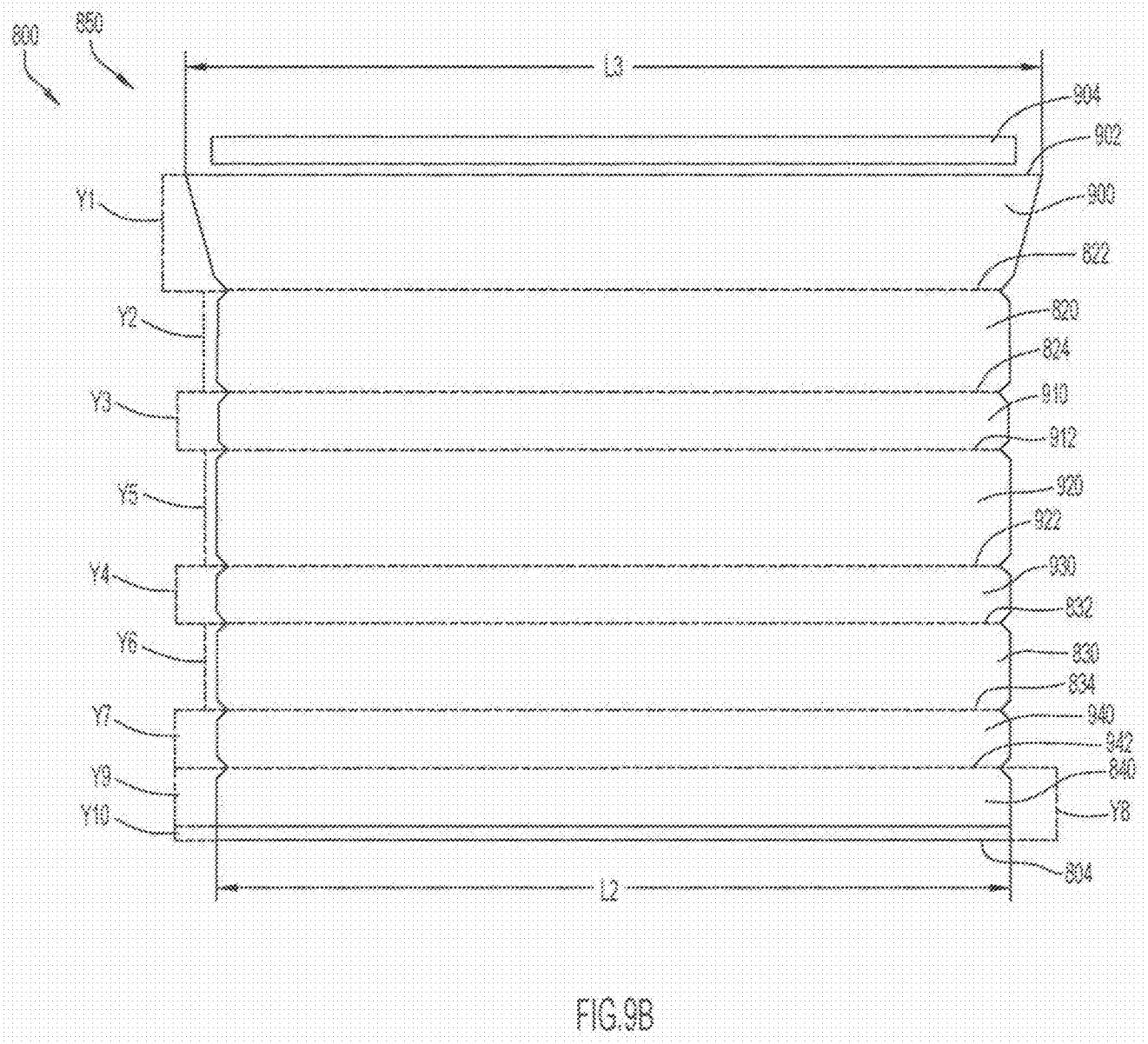
FIG. 9B illustrates a detailed view of the interior of the pocket of the embodiment of the garment illustrated in FIG. 7, where the pocket is completely unfolded and laid flat.

The backing sheet 850 of the pocket 800 being completely unfolded is illustrated in FIG. 9B. Thus, FIG. 9B illustrates each of the panels 820, 830, 840, 900, 910, 920, 930, 940 and each of the fold lines 822, 824, 832, 834, 912, 922, 942. As illustrated, the shaded panels 820, 830 are the panels that are exposed to the interior of the pants 20 when the pocket 800 is in the empty configuration C. The unshaded panels 900, 910, 920, 930, 940 are the panels that are not exposed when the pocket 800 is in the empty configuration C. As further illustrated in FIG. 9B, panel 840 is partially shaded, which indicates the portion of the panel 840 that is exposed and the portion of the panel 840 that is not exposed when the pocket 800 is in the empty configuration C.

As best illustrated in FIGS. 9A and 9B, the first unexposed panel 900 may have a height Y1 that spans between the bottom edge 902 and top edge/fold line 822. In addition, FIG. 9B illustrates that the portion of the first unexposed panel 900 proximate to the top edge/fold line 822 has a length of L2, while the portion of the first unexposed panel 900 proximate to the bottom edge 902 has a length of L3. The length L3 may be greater than the length L2, where the length L2 is also the distance between the first and second sides 806, 808 of the pocket 800. As further illustrated in FIGS. 9A and 9B, the first exposed panel 820 may have a height Y2 that spans between the top edge/fold line 822 and the bottom edge/fold line 824. The second unexposed panel 910 may have a height of Y3 that spans between the bottom edge/fold line 824 and the fold line 912, while the fourth unexposed panel 930 may have a height of Y4 that spans between the fold line 922 and the top edge/fold line 832. As best illustrated in FIG. 9B, the third unexposed panel 920 may have a height of Y5, which may be equivalent to the combination of Y3 and Y4. In other words, and as illustrated in FIG. 9A, the height Y5 of the third unexposed panel 920 may be equivalent to the combined heights of the second unexposed panel 910 and the fourth unexposed panel 930.

As further illustrated, the second exposed panel 830 may have a height of Y6 that spans between the top edge/fold line 832 and the bottom edge/fold line 834. The fifth unexposed panel 940 may have a height of Y7 that spans between the bottom edge/fold line 834 and the fold line 942. The third exposed panel 840, which is only partially exposed, may have a height of Y8 that spans between the fold line 942 and the bottom edge 804 of the pocket 800. As further illustrated, the unexposed portion of the third exposed panel 840 may have a height of Y9, which may be equivalent to the height Y7 of the fifth unexposed panel 940, and the exposed portion of the third exposed panel 840 may have a height of Y10.

In one embodiment of the pocket 800, Y1 may be equal to 1 inch, and Y2 may be equal to 0.875 inches. Heights Y3, Y4, Y7, and Y9 may all be equal to one another and equal to 0.5 inches. The height Y5 may be equal to 1 inch, while the height Y6 may be equal to 0.75 inches. In addition, height Y10 may be equal to 0.125 inches. Thus, the height Y8, which may be equal to Y9 plus Y10, may be 0.625 inches. The length L2 between the first side 810 and the second side 820 may be equal to 7.5 inches, while the length L3 of the bottom edge 902 of the first unexposed panel 900 may be 8 inches. Other embodiments of the pocket 800 may contain different dimensions.

Furthermore, as best illustrated in FIG. 8A, each of the panels 820, 830, 840, 900, 910, 920, 930, 940 and each of the fold lines 822, 824, 832, 834, 912, 922, 942 span the distance L2 across the waist pocket 800. The panels 820, 830, 840, 900, 910, 920, 930, 940 and the fold lines 822, 824, 832, 834, 912, 922, 942, moreover, are also bound or coupled to the waist portion 730 via stitching 810 and/or bar tacks 812. Because the panels 820, 830, 840, 900, 910, 920, 930, 940 and the fold lines 822, 824, 832, 834, 912, 922, 942 are bound by stitching 810 and/or bar tacks 812, when the waist pocket 800 returns to the empty configuration C from the expanded configuration D, the panels 820, 830, 840, 900, 910, 920, 930, 940 and the fold lines 822, 824, 832, 834, 912, 922, 942 are reformed and take shape.

In one embodiment, the waist pocket 800, and more specifically, the panels 820, 830, 840, 900, 910, 920, 930, 940, may be constructed from a polyester blended fabric similar to the front flaps 500, 510 or the rear side 600 of the first embodiment of the waist pocket 160. This construction, however, provides the pocket 800 with a degree of resiliency that enables the panels 820, 830, 840, 900, 910, 920, 930, 940 to stretch into the expanded configuration D, illustrated in FIGS. 12A and 12B, when an object is placed within the interior of the waist pocket 800, and return to the empty configuration C, where the plurality of panels 820, 830, 840, 900, 910, 920, 930, 940 and the plurality of fold lines 822, 824, 832, 834, 912, 922, 942 are reformed. In addition, because the panels 822, 824, 832, 834, 912, 922, 942 of the waist pocket 800 are facing the interior of the pants 20, when the pants 20 are worn by a user, the panels 822, 824, 832, 834, 912, 922, 942 may abut or contact the user. Thus, the panels 822, 824, 832, 834, 912, 922, 942 may include anti-microbial/moisture wicking properties to prevent sweat from the user's body coming in contact with the objects placed within the waist pocket 800.

Figure 10:
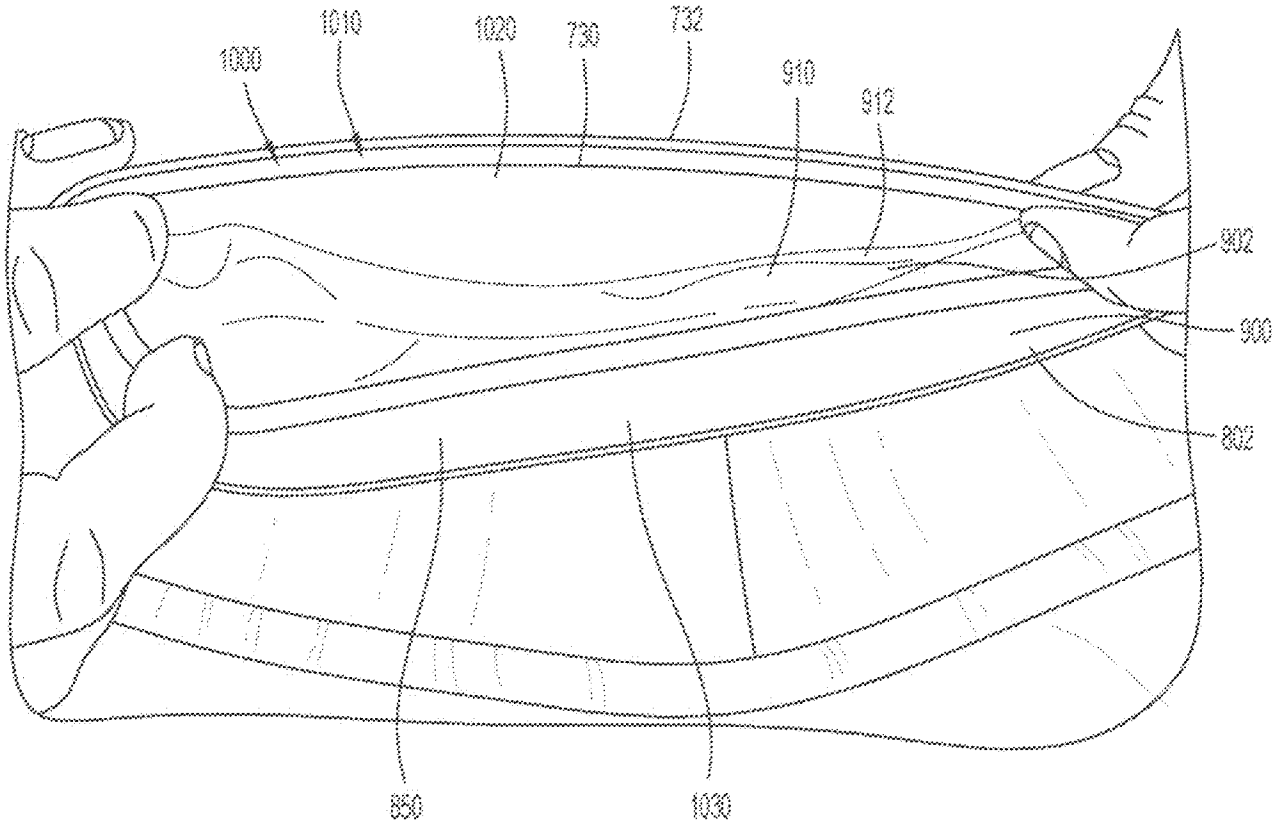
FIG. 10 illustrates a top view of the pocket of the embodiment of the garment illustrated in FIG. 7 in the open position.

In order to place objects (e.g., mobile electronic devices, wallets, credit cards, keys, etc.) within the pocket 800, the top edge 802 of the pocket 800 must first be separated from the top edge 732 of the waist portion 730 as illustrated in FIG. 10. Because the pocket 800 is disposed on the interior surface 739 of the waist portion 730, when separating the top edge 802 of the pocket 800 from the top edge 732 of the waist portion 730, the top edge 802 of the pocket 800 may be pulled towards the user wearing the pants 20 and/or the top edge 732 of the waist portion 730 may be pulled away from the user wearing the pants 20. As illustrated in FIG. 10, separating the top edge 802 of the pocket 800 from the top edge 732 of the waist portion 730 creates an opening 1000 that exposes the interior 1010 of the pocket 800. The interior 1010 of the pocket 800 may be defined by the panels 820, 830, 840, 900, 910, 920, 930, 940 and the interior surface 739 of the waist portion 730, where the interior surface 739 of the waist portion 730 is disposed opposite of the panels 820, 830, 840, 900, 910, 920, 930, 940. Thus, the interior surface 739 of the waist portion 730 may form the front side 1020 of the interior 1010 of the pocket 800, while the backing sheet 850 with panels 820, 830, 840, 900, 910, 920, 930, 940 may form at least a portion of the rear side 1030 of the interior 1010 of the pocket 800. The interior 1010 of the pocket 800 is also bound by the first and second sides 806, 808 of the pocket 800.

When viewing the interior 1010 of the pocket 800 through the opening 1000, at least some of the unexposed panels 900, 910, 920, 930, 940 and the fold lines 912, 922, 942 of the backing sheet 850 may be visible. Furthermore, the bottom edge 902 and the binding 904 of the first unexposed panel 900 may also be visible through the opening 1000.

Figure 11A:
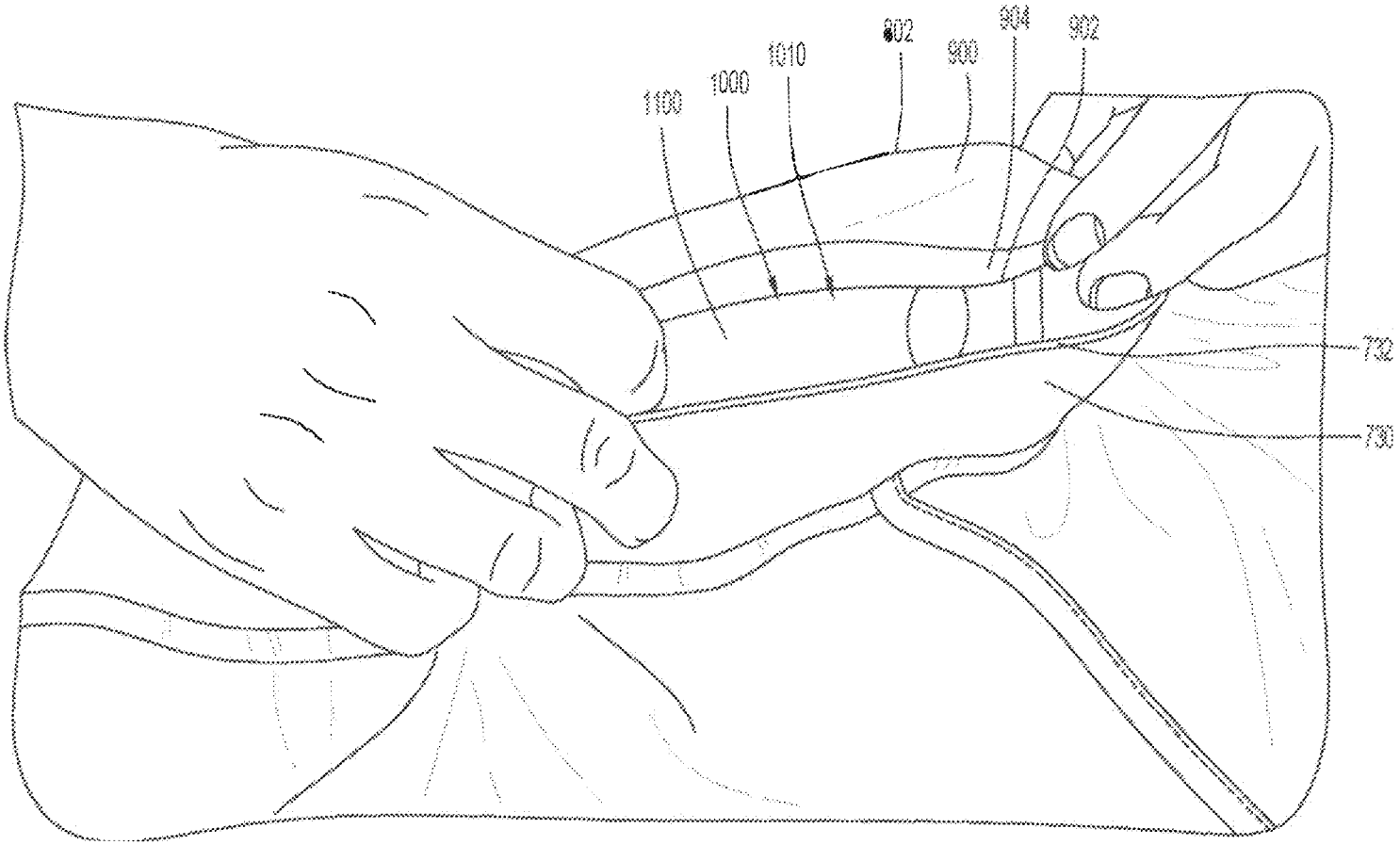
FIG. 11A illustrates a perspective view of the pocket of the embodiment of the garment illustrated in FIG. 7, where an object is being placed within the pocket.
Figure 11B:
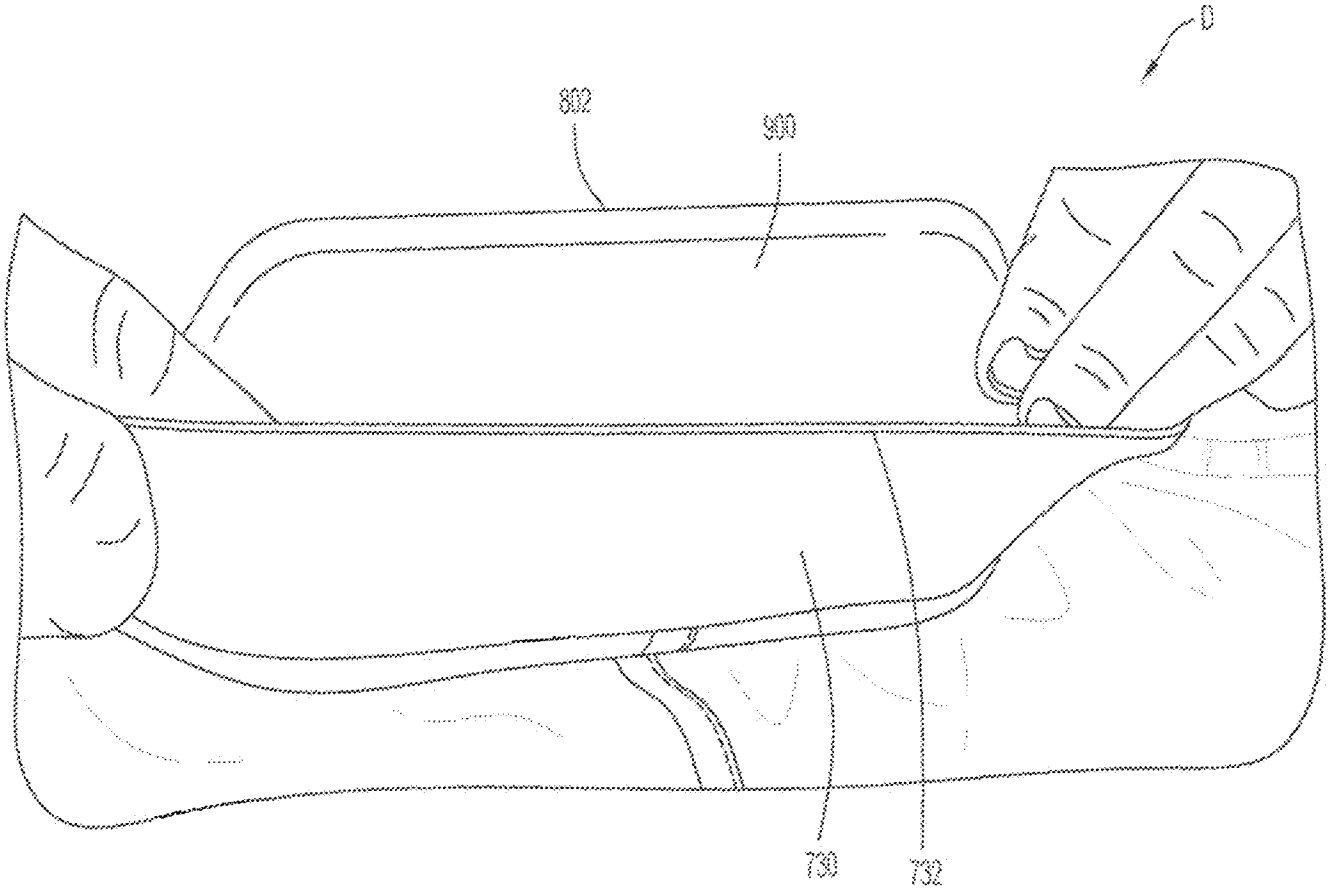
FIG. 11B illustrates a front view of the pocket of the embodiment of the garment illustrated in FIG. 7, where an object is being placed within the pocket.

Once the opening 1000 has been formed between the top edge 802 of the pocket 800 and the top edge 732 of the waist portion 730, an object 1100, such as a mobile electronic device, may be placed within the interior 1010 of the pocket 800 as illustrated in FIGS. 11A and 11B. Once placed within the interior 1010 of the pocket 800, the first unexposed panel 900 may be slipped over the object to place the object 1100 between the first unexposed panel 900 and the other panels 820, 830, 840, 910, 920, 930, 940. As illustrated in FIG. 11A, the bottom edge 902 and the binding 904 of the first unexposed panel 900 are slid over the top of the object 1100 to position the object 1100 between the first unexposed panel 900 and the other panels 820, 830, 840, 910, 920, 930, 940. The longer length L3 of the bottom edge 902 may more easily allow objects to be positioned between the first unexposed panel 900 and the other panels 820, 830, 840, 910, 920, 930, 940. As illustrated in FIG. 11B, once the object is disposed between the first unexposed panel 900 and the other panels 820, 830, 840, 910, 920, 930, 940, the user continues to slide the bottom edge 902 and the binding 904 of the first unexposed panel 900 down the object 1100 causing the other panels 820, 830, 840, 910, 920, 930, 940 of the backing sheet 850 to become at least partially unfolded along the edges/fold lines 822, 824, 832, 834, 912, 922, 942 and increasing the overall height of the pocket 800 (e.g., the distance between the bottom edge 804 and the top edge 802). The sliding of the bottom edge 902 and the binding 904 of the first unexposed panel 900 down the object 1100 causes the pocket 800 to be reconfigured from the empty configuration C to the expanded configuration D. The overall height of the pocket 800 when in the expanded configuration D may vary depending on the size of the object 1100 placed within the interior 1010 of the pocket 800. Therefore, the larger the object 1100 disposed within the pocket 800, the larger the distance between the bottom edge 804 and the top edge 802 of the pocket 800. Moreover, the larger the object 1100 disposed within the pocket 800, the more the panels 820, 830, 840, 910, 920, 930, 940 of the backing sheet 850 become unfolded. In other words, the larger the object 1100, the panels 820, 830, 840, 910, 920, 930, 940 and the fold lines 822, 824, 832, 834, 912, 922, 942 become less visible.

The bottom edge 902 and the binding 904 of the first unexposed panel 900 must be slid down the object 1100 disposed within the interior 1010 of the pocket 800 so that the bottom edge 902 and binding 904 are positioned lower than the top edge 732 of the waist portion 730. This ensures that the object 1100 is secured within the pocket 800 when the pocket 800 is in the expanded configuration D. As further illustrated, sliding the bottom edge 902 and the binding 904 of the first unexposed panel 900 down the object 1100 also raises the top edge 802 of the pocket 800 beyond the top edge 732 of the waist portion 730. The resilient and elastic nature of the panels 820, 830, 840, 900, 910, 920, 930, 940, and/or the binding 904 of the backing sheet 850 secure the object against the interior surface 739 of the waist portion 730. The resilient and elastic nature of the panels 820, 830, 840, 900, 910, 920, 930, 940, and/or the binding 904 of the backing sheet 850 also keeps the first unexposed panel 900 folded over the object 1100 disposed within the pocket 800. Because the first unexposed panel 900 is disposed over the object 1100 such that the bottom edge 902 of the first unexposed panel 900 is oriented lower than the top edge 732 of the waist portion 730, the first unexposed panel 900 serves as a cap, lid, or cover for objects 1100 placed within the interior 1010 of the pocket 800.

Figure 12A:
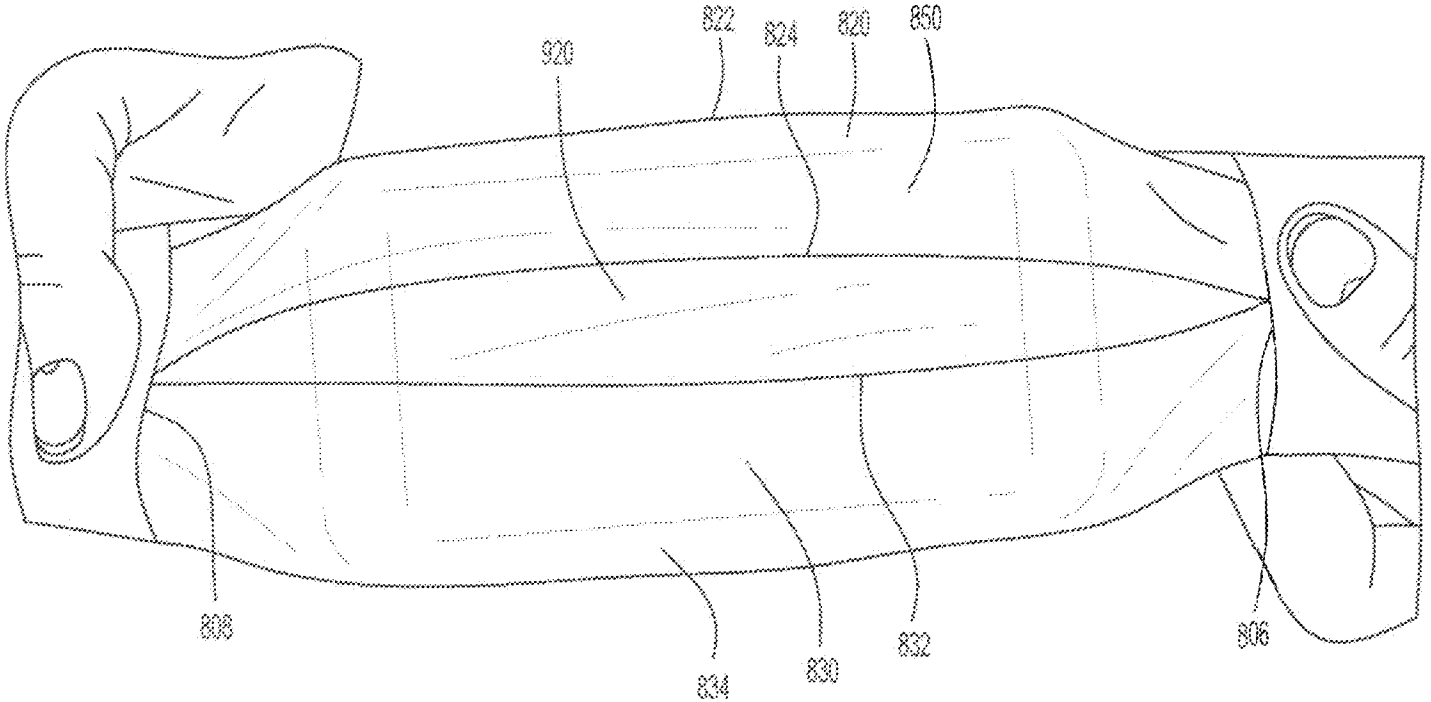
FIG. 12A illustrates a rear view of the pocket of the embodiment of the garment illustrated in FIG. 7, the pocket being in the expanded configuration.
Figure 12B:
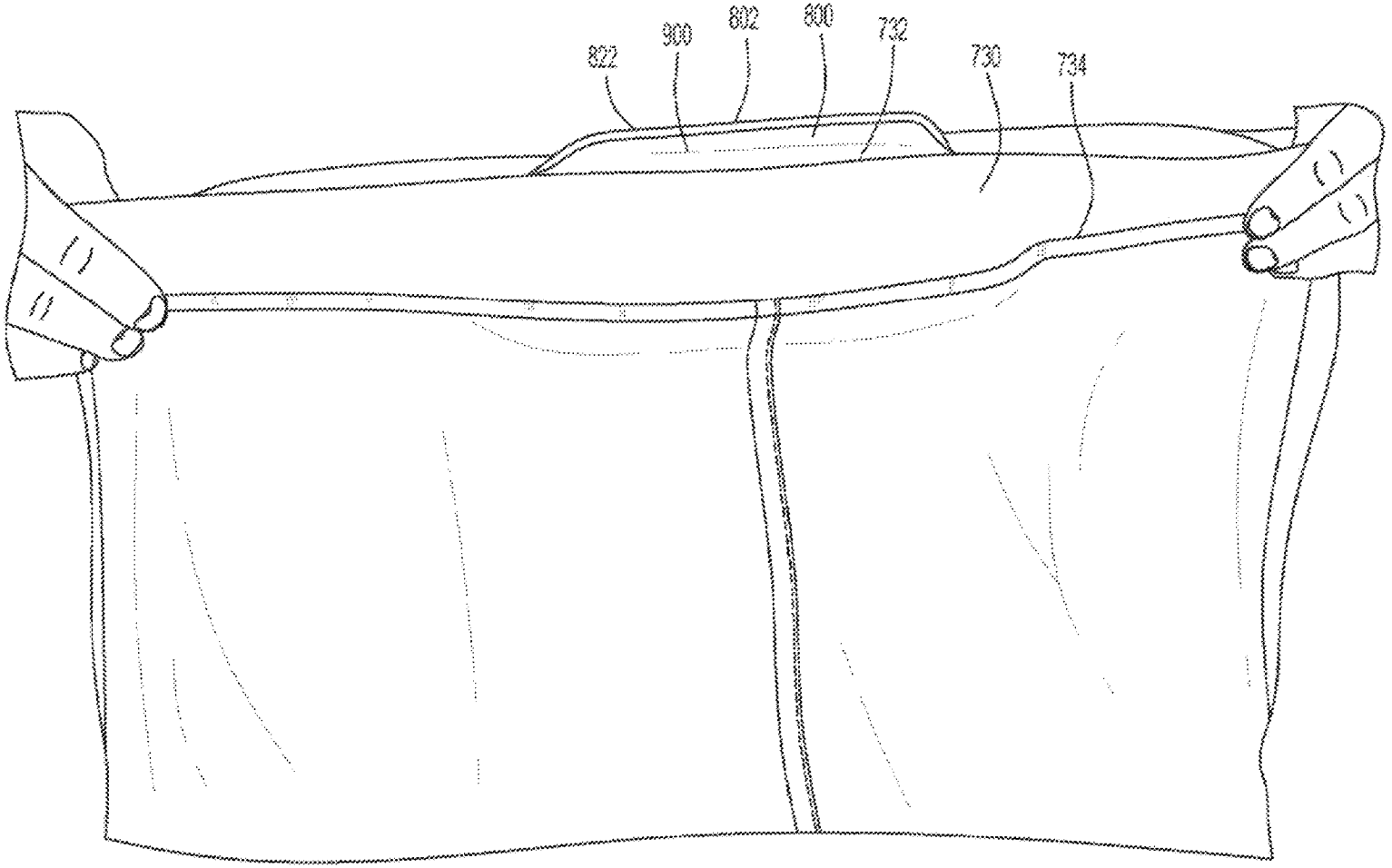
FIG. 12B illustrates a front view of the embodiment of the garment illustrated in FIG. 7, the pocket being in the expanded configuration.

As previously explained, FIGS. 12A and 12B illustrated the pocket 800 in the fully expanded configuration D, where an object 1100 is disposed within the interior 1010 of the pocket 800. As illustrated in FIG. 12A, when in the expanded configuration D, the exposed panels 820, 830, 840 separate from one another, and become at least partially unfolded, causing at least some of the unexposed panels 910, 920, 930, 940 to be visible from the interior of the pants 20. In the embodiment illustrated in FIG. 12A, the object 1100 placed within the interior 1010 of the pocket 800 causes the bottom edge 824 of the first exposed panel 820 to separate from the top edge 832 of the second exposed panel 830 to reveal at least the third unexposed panel 920. FIG. 12A further illustrates how the panels 820, 830, 840, 900, 910, 920, 930, 940 and the fold lines 822, 824, 832, 834, 912, 922, 942 of the backing sheet 850 are bound or coupled to the waist portion 730 at the first side 806 and the second side 808 of the pocket 800. Thus, once the object 1100 is removed from the pocket 800, the backing sheet 850 is returned to its configuration or form when the pocket is in the empty configuration, where the backing sheet 850 contains the panels 820, 830, 840, 900, 910, 920, 930, 940 and the fold lines 822, 824, 832, 834, 912, 922, 942.

FIG. 12B best illustrates how, when the pocket 800 is in the expanded configuration D, the top edge 802 of the pocket 800 is no longer aligned with the top edge 732 of the waist portion 730 and is disposed above the top edge 732 of the waist portion 730.

When the pants 10 and pants 20 are worn by a wearer, the waist portions 130, 730 are stretched and/or deformed outwardly or laterally. More specifically, when the waist portions 130, 730 are stretched and/or deformed laterally, the openings 136, 736 formed by the waist portions 130, 730, respectively, increase in diameter.

With respect to the first embodiment of the pants 10, the lateral stretching of the waist portion 130 causes the first flap 500 to also stretch laterally. Because the first flap 500 is fixedly coupled to the top edge 732 of the waist portion 130 and the first and second sides 506, 508, the lateral stretching of the first flap 500 creates a tension closure over the second flap 510 to secure the pocket 160 closed. Because of the first and second seams 614, the lateral stretching of the waist portion 130 creates opposing tensile forces on the pocket 160, which causes the first flap 500 to press against the second flap 510. In other words, the opposing tensile forces cause the interior surface of the first flap 500 to abut or contact the exterior surface of the second flap 510. As the amount or degree of stretching of the waist portion 130 in the outward or lateral direction increases, the amount of the opposing tensile forces that act on the first flap 500 also increases. Thus, the greater the amount of stretching of the waist portion 130, the stronger the amount of tension in the first flap 500 that keeps the first flap 500 pressed against the second flap 510 to secure items within the pocket 160. In other words, as the lateral load on the waist portion 130 increases, the forces that force the first flap 500 to locks down onto the second flap 510 to secure items within the pocket 160 also increases.

Continuing with the first embodiment of the pants 10, the first and the second flaps 500, 510 and the rear side 600 may together act as an adaptable and dynamic pocket system. Because each of the first and the second flaps 500, 510 and the rear side 600 are constructed from materials with the same or similar degrees of resiliency, the pocket 160 is adaptable to the person wearing the pants 10 and the items stored within the pocket 160 of the pants 10. Because of the resilient nature of the flaps 500, 510 and the rear side 600, as the lateral load on the waist portion 130 increases, the opposing tensile forces on these components 500, 510, 600 also increases, causing these components 500, 510, 600 to stretch laterally. These components 500, 510, 600, however, are configured to stretch simultaneously, or in unison, so that the first flap 500 still serves as a tension closure to the pocket 160. As previously explained, as the amount or degree of stretching of the waist portion 130 in the outward or lateral direction increases, the opposing tensile forces that act on the components 500, 510, 600 also increases.

With respect to the second embodiment of the pants 20, the lateral stretching of the waist portion 730 causes the backing sheet 850 to also stretch laterally. Because the backing sheet 850 is fixedly coupled to the waist portion 730 at the first and second sides 806, 808 of the pocket 800, the lateral stretching of the backing sheet 850 creates a tension closure to secure the pocket 800 closed. More specifically, because of the first and second seams 810 and/or the bar tacks 812, the lateral stretching of the waist portion 730 creates opposing tensile forces on the pocket 800, which causes the first unexposed panel 900 to press against the exposed portion of the backing sheet 850. The opposing tensile forces on the pocket 800 also causes the backing sheet 850, including the first unexposed panel 900, to press against the interior surface 739 of the waist portion 730, which closes the opening 1000. In addition to the tensile forces imparted onto the pocket 800 by the lateral stretching of the waist portion 730, because the backing sheet 850 is disposed on the interior surface 739 of the waist portion 730 (i.e., the side of the waist portion 730 that faces the user wearing the pants 20), when the pants 20 are worn by a user, the user's body presses the backing sheet 850 against the interior surface 739 of the waist portion 730. As the amount or degree of stretching of the waist portion 730 in the outward or lateral direction increases, the amount of the opposing tensile forces that act on the first unexposed panel 900 and the remaining portions of the backing sheet 850 also increases. Thus, the greater the amount of stretching of the waist portion 730, the stronger the amount of tension in the first unexposed panel 900 that keeps the first unexposed panel 900 pressed against the remaining portions of the backing sheet 850 to secure items within the pocket 800.

The backing sheet 850 acts together with the waist portion 730 as an adaptable and dynamic pocket system. Because the backing sheet 850 and the waist portion 730 are constructed from materials with the same or similar degrees of resiliency, the pocket 800 is adaptable to the person wearing the pants 20 and the items stored within the pocket 800 of the pants 20. Because of the resilient nature of the backing sheet 850 and the waist portion 730, as the lateral load on the waist portion 730 increases, the opposing tensile forces on backing sheet 850 also increases, causing backing sheet 850 to stretch laterally. The backing sheet 850, however, is configured to stretch simultaneously, or in unison, with the waist portion 730 so that the first unexposed panel 900 and the remaining portions of the backing sheet 850 still serve as a closure to the pocket 800. As previously explained, as the amount or degree of stretching of the waist portion 730 in the outward or lateral direction increases, the opposing tensile forces that act on the backing sheet 850 also increases.

With the pockets 160, 800 being disposed on the front side 100, 700 of pants 10, 20, respectively, the pockets 160, 800 are easily accessible by users wearing the pants 10, 20. Thus, users may easily secure objects 1100 within the pockets 160, 800 while wearing the pants 10, 20 and performing activities (e.g., running, playing sports, working out, etc.). It then follows that objects disposed within the pockets 160, 800 are also easily accessed by users wearing the pants 10, 20 while also performing activities.

Garment with Arcuate Edge Flap at Opening to Waist Pocket

With reference now to FIGS. 13-15B, an alternative embodiment of a garment in the form of pants 2010 with a waist pocket is shown, the waist pocket having a tension closure with an arcuate flap provided at an opening to the tension pocket. The embodiment of the pants 2010 illustrated in FIGS. 13-16B include an upper portion 2100 of the garment (which may also be referred to herein as a "waistband") defining an opening 2102 proximate the top side of the pants. The pants 2010 further include a lower portion with a first leg portion 2200 defining a first leg opening 2210 at a bottom side 2022 of the pants, and a second leg portion 2300 defining a second leg opening 2310 at the bottom side of the pants. As illustrated, the waist portion 2100 is disposed proximate to the top 2020 of the pants 2010, and extends around each of the sides of the pants 2010, including the front side and the rear side 2014.

Figure 14:
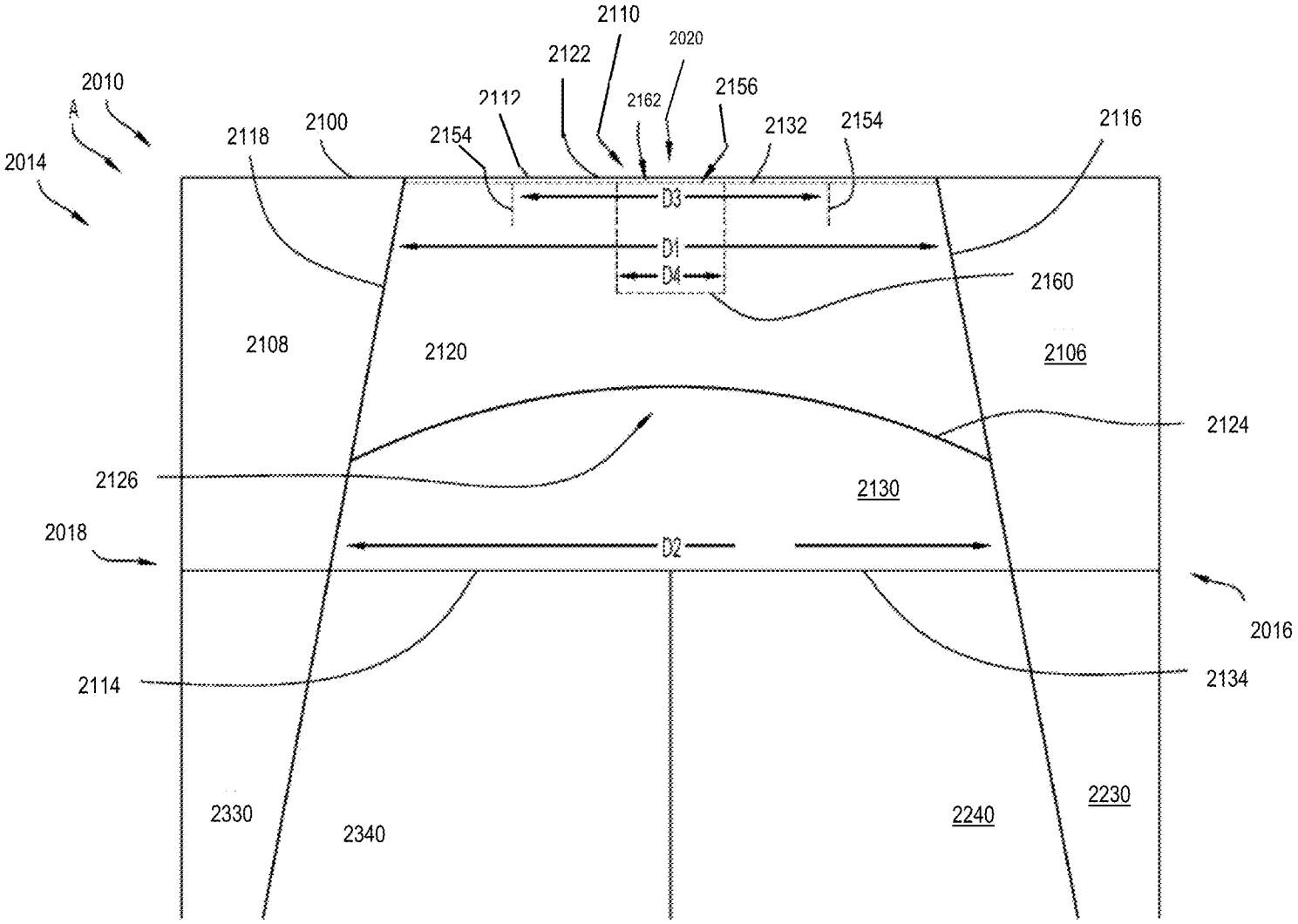
FIG. 14 illustrates a schematic view of the pocket of the embodiment of the garment illustrated in FIG. 13A.

As further illustrated, the waist portion 2100 is constructed of a first/front fabric panel (not shown), a second fabric panel 2106, a third fabric panel 2108, and a fourth fabric panel 2110. The first fabric panel may be centrally oriented on the front side of the pants 2010, with the second fabric panel 2106 being disposed primarily on the first side 2016 of the pants 2010 and the third fabric panel 2108 being disposed primarily on the second side 2018 of the pants 2010. The first fabric panel may be coupled to the second fabric panel 106 and the third fabric panel 108. The fourth fabric panel 2110 may be disposed centrally on the rear side 2014 of the pants 2010 and coupled to the second and third fabric panels 2106, 2108. The panels (including panels 2106, 2108, and 2110) collectively define a top edge 2112 of the waist portion 2100 and a bottom edge 2114 of the waist portion 2100, where the bottom edge 2114 of the waist portion 2100 is disposed opposite of the top edge 2112. The fourth fabric panel 2110 is coupled to the second fabric panel 2106 via a first seam 2116 and is coupled to the third fabric panel 2108 via a second seam 2118. Thus, the fourth fabric panel 110 is defined by the top edge 2112 of the waist portion 2100, the bottom edge 2114 of the waist portion, the first seam 2116 and the second seam 2118. As best illustrated in FIG. 14, the first and second seams 2116, 2118 are angled such that the first and second seams 2116, 2118 are converging towards one another proximate to the top 2020 of the pants 2010. The width D1 of the fourth fabric panel 2110 proximate the top edge 2112 of the waist portion 2100 is shorter in length than the width D2 of the fourth fabric panel 2110 proximate to the bottom edge 2114 of the waist portion 2100. Thus, as illustrated, the fourth fabric panel 2110 is substantially trapezoidal.

The fabric panels 2106, 2108, 2110 may be coupled to one another via stitching, such as, but not limited to, flatlock stitching, overlock stitching, blind stitching, etc. In addition, the fabric panels 2106, 2108, 2110 may be coupled to one another by means other than stitching, such as, but not limited to, bonding, adhesives, etc. In other embodiments of the pants 2010, the waist portion 2100 may be formed from any number of fabric panels. Additionally, the fabric panels 2106, 2108, 2110 may be constructed from a blend of nylon and spandex (a polyester-polyurethane copolymer). In one embodiment, the fabric panels 2106, 2108, 2110 may be constructed from a warp knit blend of 71% nylon and 29% elastane. Thus, the panels 2106, 2108, 2110 of the waist portion 2100 are resilient/elastomeric and are configured to stretch, deform, and take the shape of a portion of the body (e.g., the waist) of the user wearing the pants 2010. In other embodiments of the pants 2010, however, the fabric panels 2106, 2108, 2110 of the waist portion 2100 may be constructed from other types of fabric that enable the waist portion 2100 to stretch and deform to the body of the user wearing the pants 2010.

As illustrated in FIGS. 13A-15B, the fourth panel 2110 of the waist portion 2100 includes a first flap 2120 and a second flap 2130. The first flap 2120 may include a top edge 2122 disposed proximate to the top 2020 of the pants 2010 and bottom edge 2124 opposite of the top edge 2122. The top edge 2122 of the first flap 2120 may be fixedly coupled to the top edge 2112 of the waist portion 2100. In addition, the sides of the first flap 2120 may be fixedly coupled to the first and second seams 2116, 2118. The bottom edge 2124 is arcuate, or, in other words, contains a curvature 2126. In the embodiment shown herein, the curvature is concave from a top perspective (i.e., the bottom edge curves upward from the first side 2016, peaks near a center of the rear portion 2014, and curves downward to the second side 2018). Because of the angled first and second seams, the top edge 2122 of the first flap 2120 is shorter in length than the bottom edge 2124 of the first flap 2120, making the first flap substantially trapezoidal (with the curvature 2126 provided along one of the bottom edge 2124).

As best illustrated in FIG. 14, the second flap 2130 includes a top edge 2132 (shown in phantom/dotted line) oriented proximate to the top 2020 of the pants 2010 and the top edge 2112 of the waist portion 2100. The top edge 2132 of the second flap 2130 is disposed underneath the first flap 2120 (i.e., the top edge 2132 of the second flap 2130 is on an interior side of the first flap 2120). Thus, the first flap 2120 at least partially lies overtop the second flap 2130 such that the top edge 2132 of the second flap 2130 is covered by the first flap 2120. The second flap 2130 further includes a bottom edge 2134 opposite of the top edge 2132, the bottom edge 2134 being exposed and fixedly coupled to the bottom edge 2114 of the waist portion 2100. Therefore, the second flap 2130 is also fixedly coupled to the third fabric panel 2240 of the first leg portion 2200 and the third fabric panel 2340 of the second leg portion 2300. As further illustrated, the second flap 2130 is further fixedly coupled to the second and third panels 2106, 2108 of the waist portion 2100 via the first seam 2116 and the second seam 2118, respectively. Because of the angling of the first and second seams 2116, 2118, the second flap 2130 is also substantially trapezoidal, where the top edge 2132 of the second flap 2130 is approximately equal to the width D1, and the bottom edge 2134 of the second flap 2130 is approximately equal to the width D2, where the D2 is greater than D1.

Because the first flap 2120 and the second flap 2130 form part of the fourth panel 2110 of the waist portion 2100, similar to the fourth panel 2110, the first and second flaps 2120, 2130 may be constructed from a blend of nylon and spandex (a polyester-polyurethane copolymer). In one embodiment, the flaps 2120, 2130 may be constructed from a warp knit blend of 71% nylon and 29% elastane. Thus, the flaps 2120, 2130 are resilient/elastomeric and are configured to stretch and deform. In other embodiments of the pants 2010, however, the flaps 2120, 2130 of the waist portion 2100 may be constructed from other types of fabric that enable the waist portion 2100 to stretch and deform to the body of the user wearing the pants 2010.

Figure 13A:
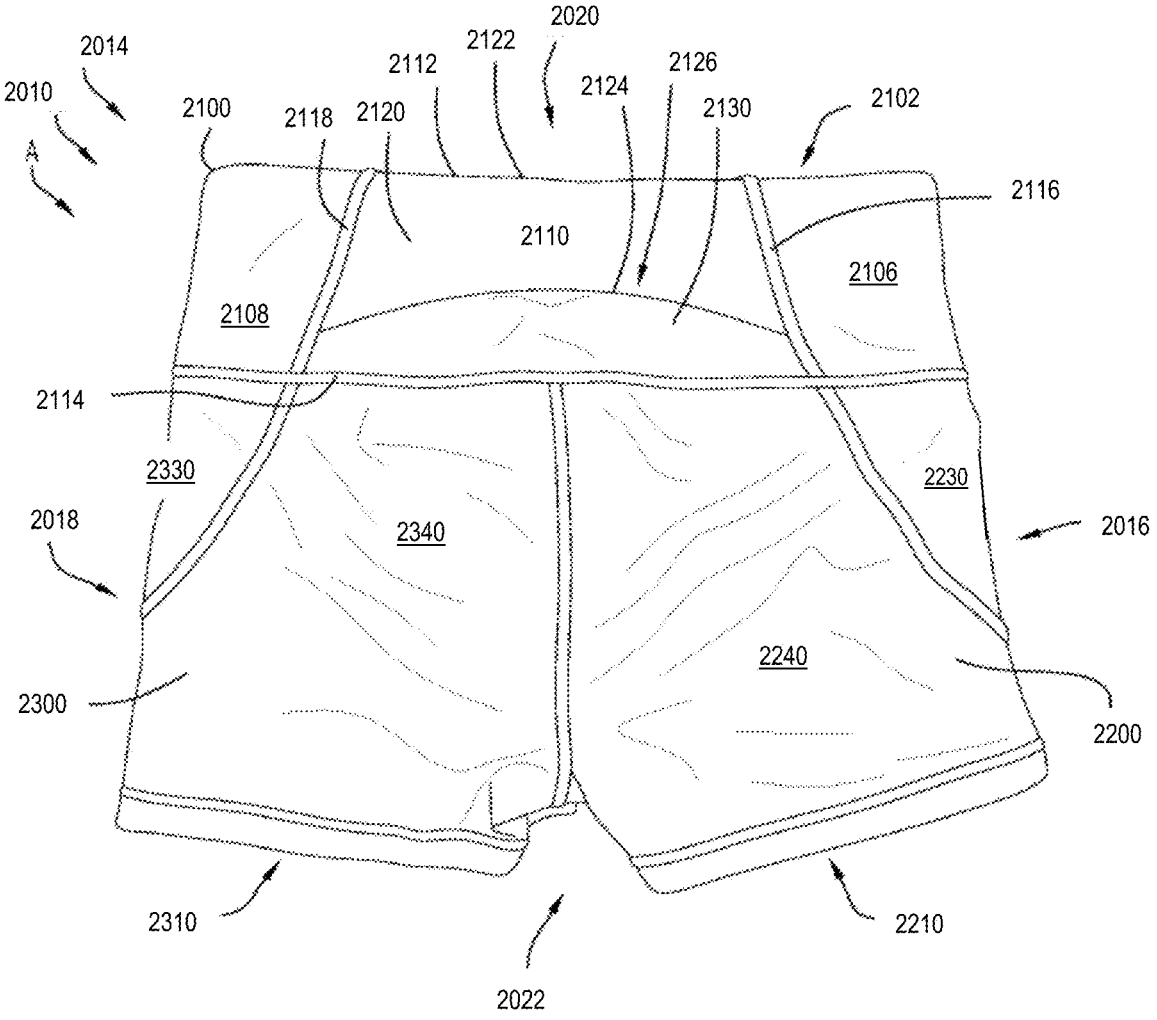
FIG. 13A illustrates a rear view of a garment in accordance with a third embodiment of the present invention.
Figure 13B:
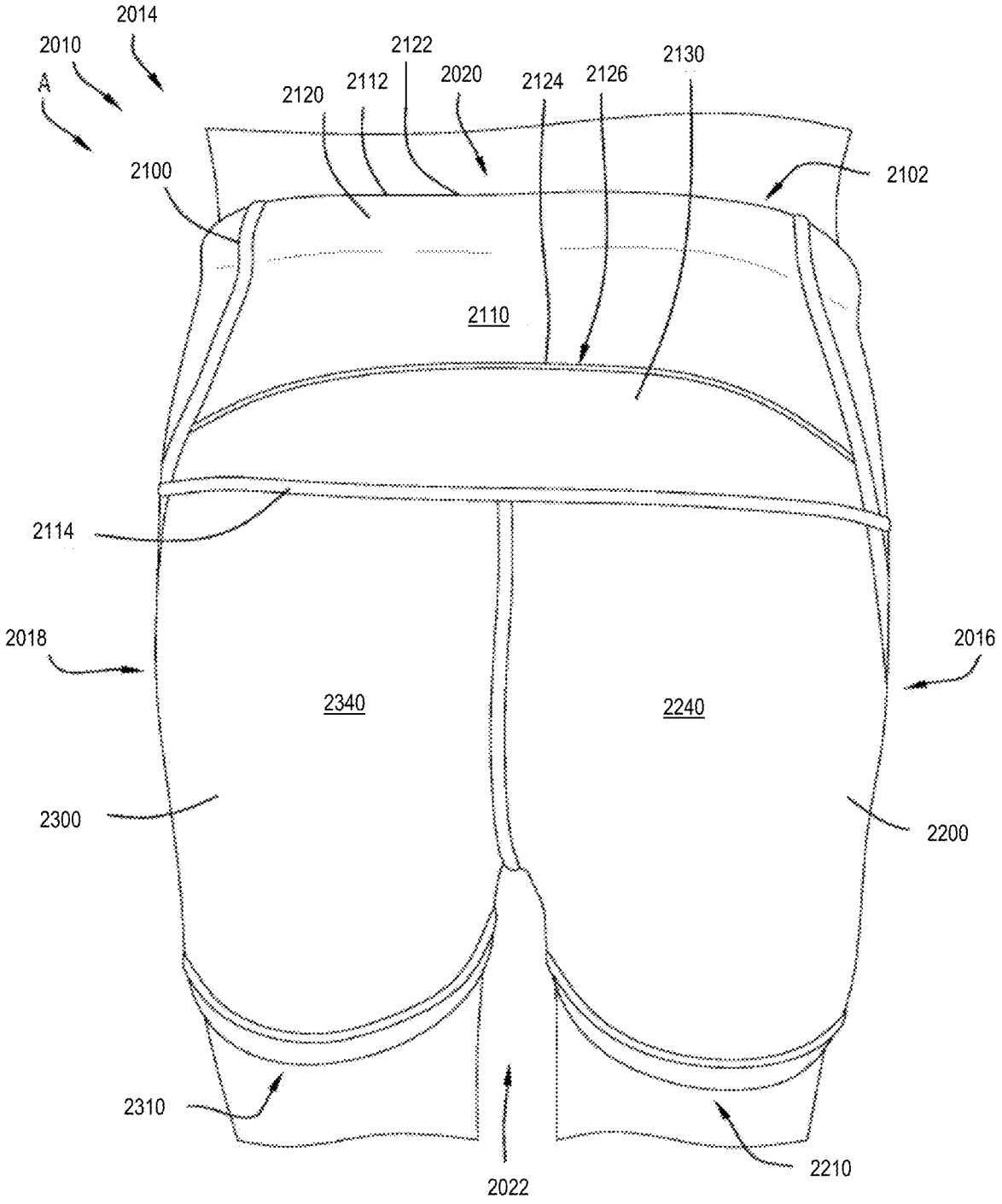
FIG. 13B illustrates a rear view of the embodiment of the garment illustrated in FIG. 13A while being worn by a user.
Figure 15A:
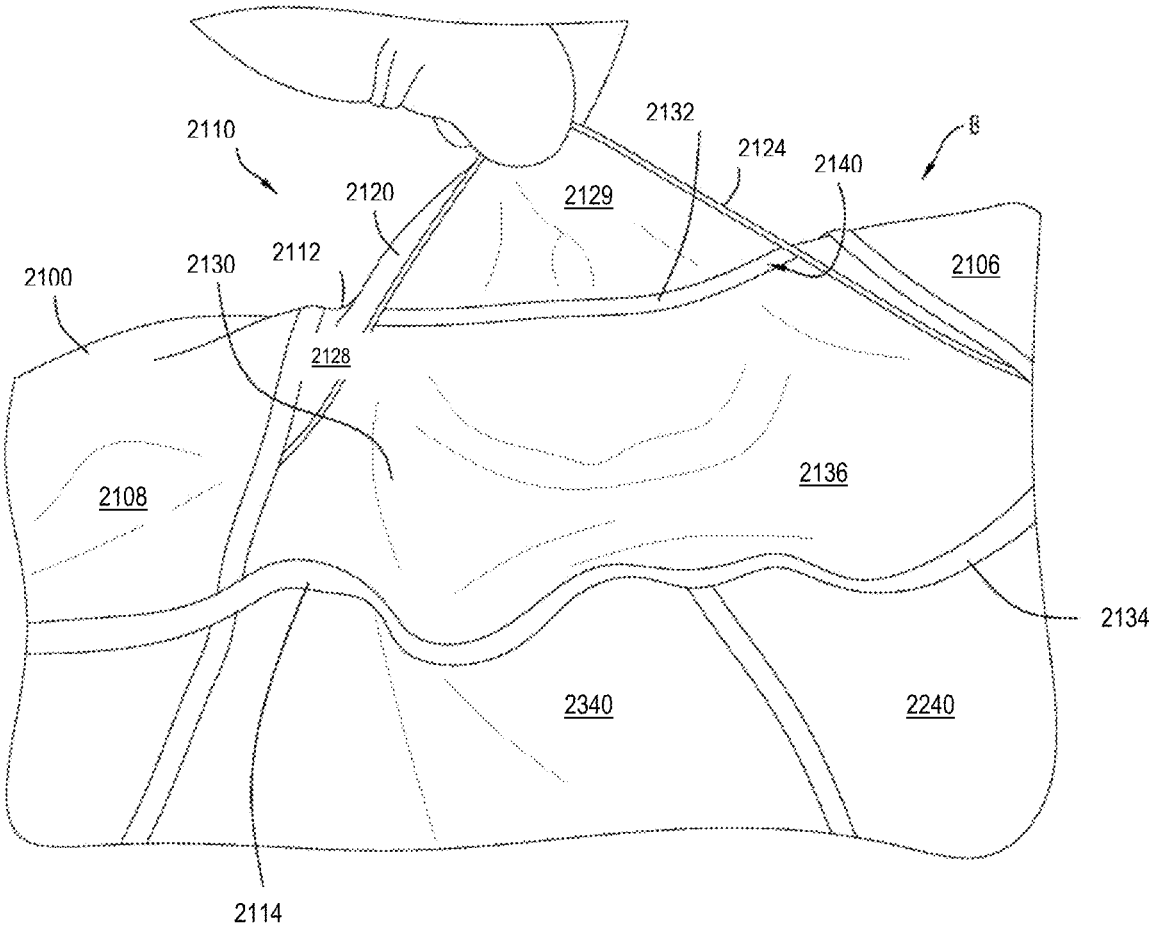
FIG. 15A illustrates an elevational view of the pocket of the embodiment of the garment illustrated in FIG. 13A being opened.
Figure 15B:
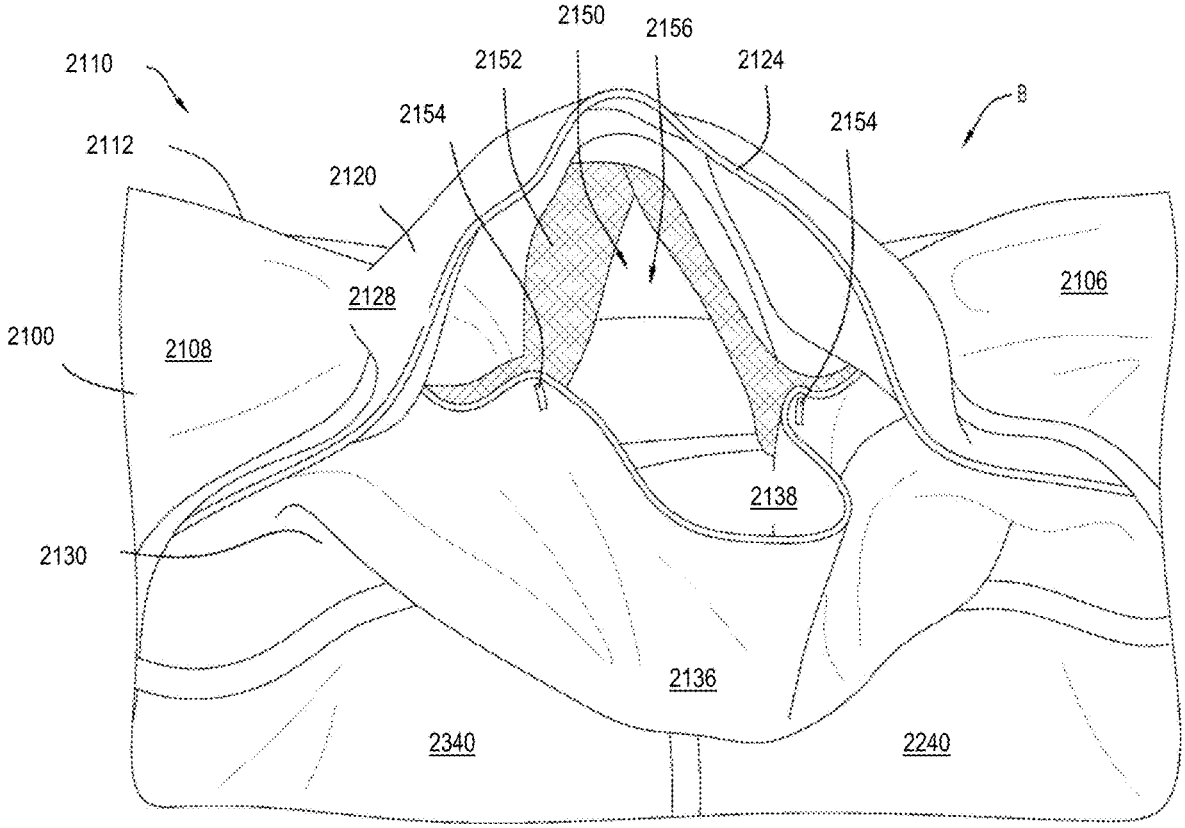
FIG. 15B illustrates a top view the interior of the pocket of the embodiment of the garment illustrated in FIG. 13A.
Figure 16:
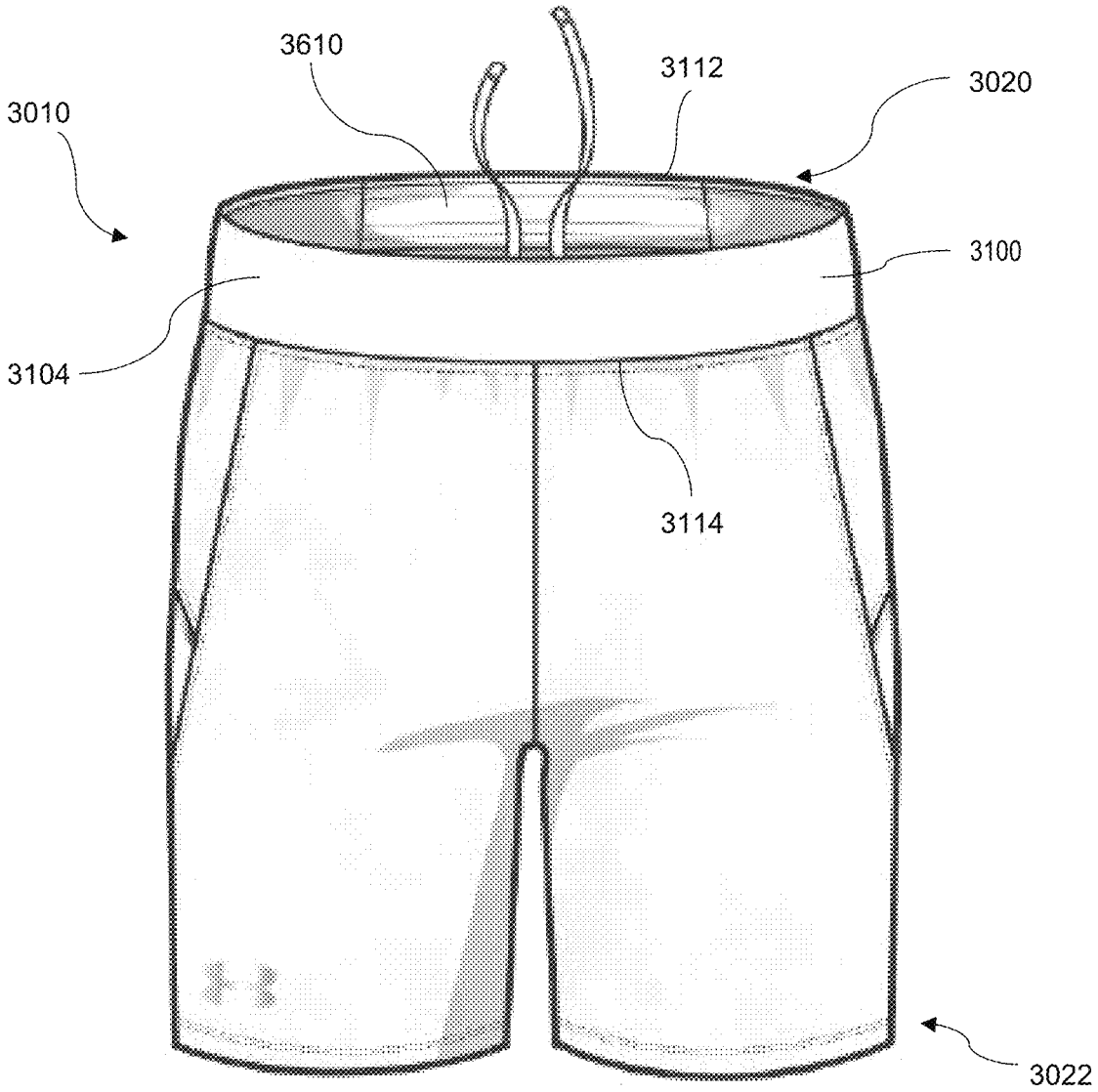
FIG. 16 illustrates a front view of a garment in accordance with a fourth embodiment of the present invention including a pocket panel disposed on an interior of a waistband with an access opening via flaps on an exterior of the waistband.
Figure 17:
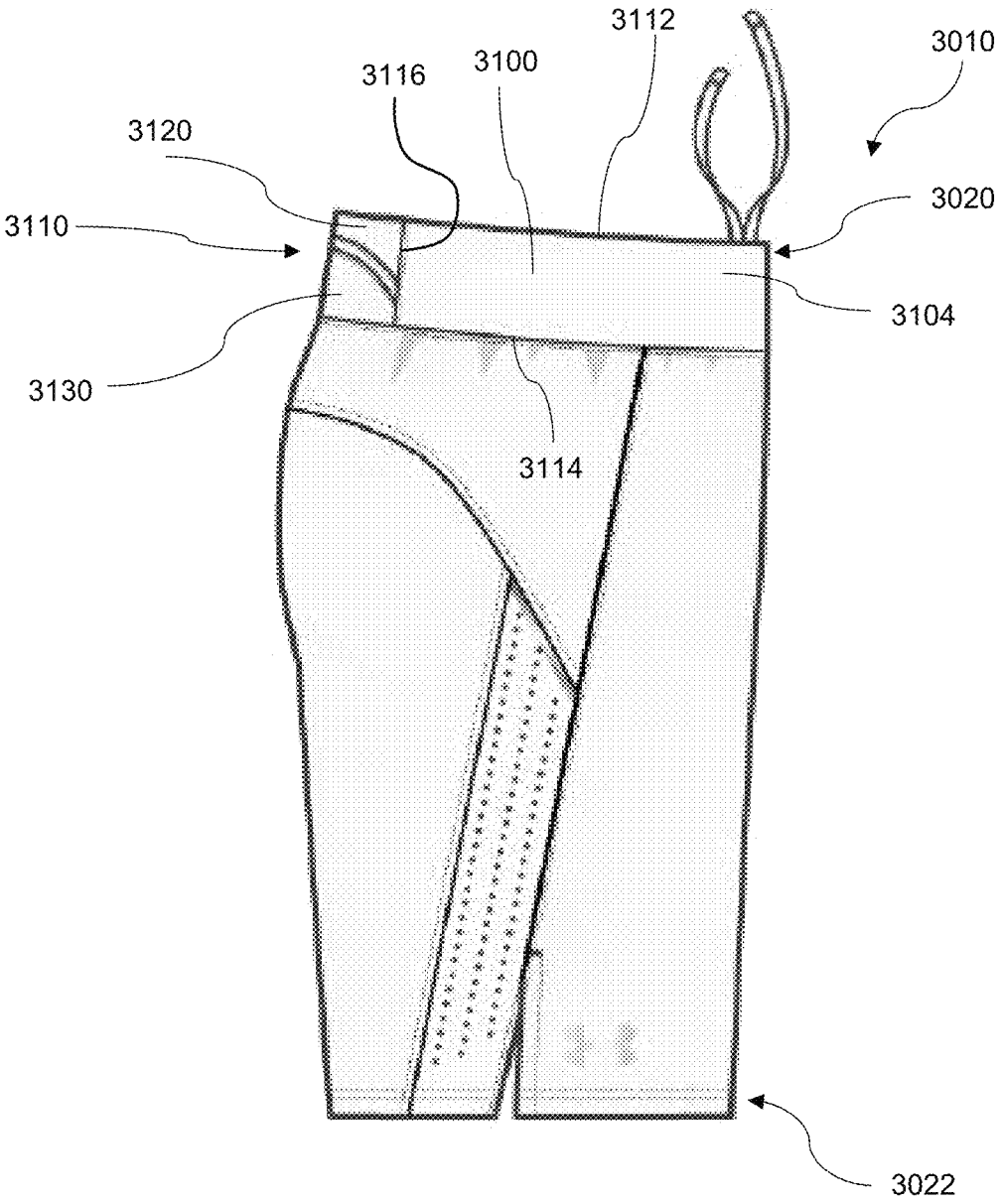
FIG. 17 illustrates a side view (i.e., right side) of the embodiment of the garment illustrated in FIG. 16.
Figure 18:
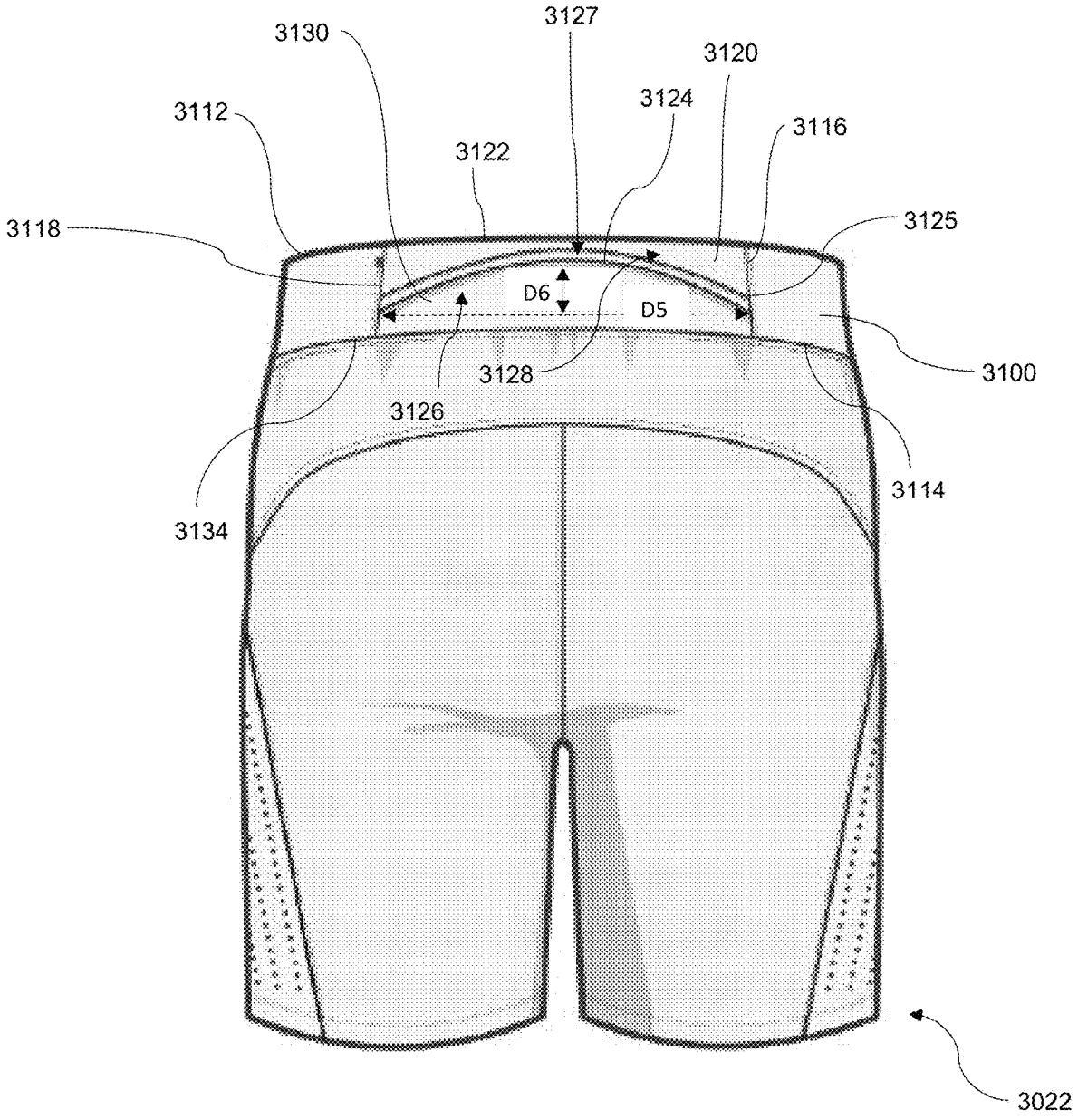
FIG. 18 illustrates a rear view of the embodiment of the garment illustrated in FIG. 16.

FIGS. 13, 13B, and 14 illustrate the first and second flaps 2120, 2130 in a closed position A, while FIGS. 15A and 15B illustrate the first and second flaps 2120, 2130 in various states of an open position B. As best illustrated in FIGS. 15A and 15B, the first flap 2120 has an exterior surface 2128 and an interior (user facing) surface 2129. Similarly, the second flap 2130 has an exterior surface 2136 and an interior (user facing) surface 2138. When in the closed position A, the first flap 2120 lies at least partially over the second flap 2130, such that the interior surface 2129 of the first flap 2120 abuts against, contacts, or is adjacent to the exterior surface 2136 of the second flap 2130. Additionally, when in the closed position A, the bottom edge 2124 of the first flap 2120 is oriented lower than the top edge 2132 of the second flap 2130, such that the first flap 2120 covers the top edge 2132 of the second flap 2130. In other words, in the closed position A, the top edge 2132 of the second flap 2130 is oriented closer to the top edge 2112 of the waist portion 2100 than the bottom edge 2124 of the first flap 2120, which overlies the second flap 2130. When in the open position B, however, the first flap 2120 is at least partially pulled away from the second flap 2130, such that at least a portion of the interior surface 2129 of the first flap 2120 is disposed or spaced away from the exterior surface 136 of the second flap 130. Thus, in the open position B, at least a portion of the interior surface 2129 of the first flap 2120 is oriented farther away from the exterior surface 2126 of the second flap 2130 than when in the closed position A.

Once the first flap 2120 is oriented to the open position B, as illustrated in FIG. 15A, an opening 2140 to a pocket 2150 is created between the first flap 2120 and the second flap 2130 (i.e., between the bottom edge 2124 of the first flap 2120 and the top edge 2132 of the second flap 2130). The opening 2140 provides access to the pocket 2150 via the bottom edge 2124 of the first flap 2120, which can be pulled upward, and the top edge 2132 of the second flap 2130, which can be pulled downward, in order to access the pocket 2150. In other words, the bottom edge 2124 of the first flap 2120 may be pulled closer to the top edge 2112 of the waist portion 2100, while the top edge 2132 of the second flap 2130 may be pulled downward, away from the top edge 2112 of the waist portion 2100. Thus, the top edge 2132 of the second flap 2130 may be at least partially exposed in the open position B, such that the first flap 2120 does not cover or overlie the entire top edge 2132 of the second flap 2130. By pulling the top edge 2132 of the second flap 2130 downward and the bottom edge 2124 of the first flap 2120 upward, access is provided to pocket 2150 via the opening 2140.

As illustrated in FIG. 15B, the pocket 2150 includes a backing material 2152, which together, with the second flap 2130 defines the limits of the pocket 2150. In the embodiment illustrated, the backing material 2152 is constructed from a mesh or stretch fabric that has a resiliency or elasticity similar to that of the panels 2106, 2108, 2110 of the waist portion 100 of the pants 10. Thus, the backing material 2152 may also be configured to stretch and deform with the panels 2106, 2108, 2110 of the waist portion 2100. In another embodiment, the backing material 2152 may be constructed from other types of fabric, and the backing material 2152 may not be resilient/elastic and configured to stretch like that of the panels 2106, 2108 of the waist portion 2100. The backing material 2152 may be fixedly coupled to the top edge 2122 of the first flap 2120 and the top edge 2112 of the waist portion 2100 proximate to the top 2020 of the pants 2010. While not illustrated, the backing material 2152 may also be fixedly coupled to the bottom edge 2114 of the waist portion 2100 and the first and second angled seams 2116, 2118 that couple the second and third panels 2106, 2108 of the waist portion 2100 to the first and second flaps 2120, 2130 of the fourth panel 2110 of the waist portion.

As further illustrated in FIGS. 14 and 15B, the second flap 2130 is coupled to the backing material 2152 via two sets of stitching 2154 at locations that are proximate to the top edge 2132 of the second flap 2130. The two sets of stitching 154 are spaced apart from one another to create an aperture 2156 that provides access to the pocket 2150. While the stitching 2154 is shown as interior of the seams 2116, 2118 in the figures, in at least some embodiments the stitching 2154 may be provided as part of the seams 2116, 2118. In each case, the aperture 2156 of the pocket 2150 is disposed proximate to the top edge 2132 of the second flap 2130, which is covered by the first flap 2120 when the flaps 2120, 2130 are in the closed position A. Therefore, when in the closed position A, the first flap 2120 also covers the aperture 2156 of the pocket 2150. The aperture 2156 may have a width or diameter D3 that is defined by the space between the two sets of stitching 2154. The width D3 of the opening is smaller in size than the width D1 of the top edge 2122 of the first flap 2120, which is smaller than the width of the bottom edge 2124 of the first flap 2120. Thus, the first flap 2120 is not only disposed over the aperture 2156 of the pocket 2150, the first flap 2120 is also wider than the aperture 2156 of the pocket 2150. In addition to defining the aperture 2156 of the pocket 150, the two sets of stitching 2154 further retain the top edge 2132 of the second flap 2130 in position under the first flap 2120 and proximate to the top edge 2112 of the waist portion 2100. This prevents the second flap 2130 from being reconfigured to cover the first flap 2120, and aids in preventing items positioned within the pocket 2150 from falling out of the pocket 2150.

As will be recognized from the figures, the pocket 2150 is substantially equivalent to the size and shape of the second flap 2130, and consequently, the fourth panel 2110. The pocket 2150, which is defined by and disposed between the backing material 2152 and the second flap 2130, spans from the top edge 2112 of the waist portion 2100 to the bottom edge 2114 of the waist portion 2100, and between the first and second angled seams 2116, 2118 that couple the third and fourth panels 2106, 2108 to the first and second flaps 2120, 2130 of the fourth panel 2110. Thus, the pocket 2150 is substantially trapezoidal. The pocket 2150 may be sized and shaped to receive and securely retain small personal items, such as portable electronic devices (e.g., smartphones), keys, credit cards, identifications, etc.

Garment with Pleated Waist Pocket and Tension Closure

With reference now to FIGS. 16-21, an alternative embodiment of a garment is shown in the form of pants 3010 with a pleated waist pocket having a tension closure. The pants 3010 include a combination of features found in the embodiments of FIGS. 1-15B, above, as well as a pocket 3150 formed from a resilient pleated panel 3600 disposed on a rear side 3014 of the pants. Similar to the above-described embodiments, the pants 3010 include a bottom/lower portion 3022 configured to be positioned around at least one leg of a person wearing the garment. The pants 3010 further include a top/upper portion 3020 in the form of a waistband 3100 coupled to the lower portion 3022 and configured to be oriented around a waist of the person wearing the garment.

The waistband 3100 is comprised of one or more fabric panels that define a top edge 3112 of the waistband and a bottom edge 3114 of the waistband. In the disclosed embodiment, a plurality of fabric panels are coupled together to form the waistband 3100, including a front fabric panel 3104 and a plurality of rear fabric panels 3110. The rear fabric panels 3110 may be generally trapezoidal in shape (similar to the rear panels of the embodiment of FIGS. 13A-15B) and are secured to the waistband along a first angled seam 3116 on a right side of the waistband 3100, and a second angled seam 3118 on an opposite left side of the waistband. The rear fabric panels 3110 include a first panel defining a first flap 3120 and a second panel defining a second flap 3130. The word "flap" is used herein to define these panels because, as explained below, a significant portion of one side of each panel/flap is not coupled to the other panel/flap and such side is therefore freely moveable relative to the other panel/flap.

The first flap 3120 of the waistband 3100 includes a top edge 3122 and an arcuate bottom edge 3124. The top edge 3122 of the first flap 3120 extends along the top edge 3112 of the waistband 3100 and is stitched or otherwise coupled to the resilient pleated panel 3600 along the top edge 3112 of the waistband. The arcuate bottom edge 3124 of the first flap 3120 has a defined curvature 3126 that extends some lateral distance (D5) and some vertical distance (D6) across the rear of the pants 3010. For example, the bottom edge 3124 may have a curvature 3126 that (a) extends laterally about five to seven inches across the rear of the pants (e.g., D5=6"), and (b) extends vertically about one to two inches from a first vertical position at a lowermost right end 3125 of the bottom edge 3124 (or lowermost right end of the bottom edge) to a second vertical position at a center vertex 3127 of the bottom edge 3124 (e.g., D6=1.5"). The bottom edge 3124 of the first flap 3120 is more centrally positioned on the waistband 3100 with the lowermost right edge 3125 (and lowermost left edge) closer to the bottom edge 3114 of the waistband 3100 and the center vertex 3127 closer to the top edge 3112 waistband. The left and right sides of the first flap 3120 are also stitched or otherwise coupled to the left and right seams 3116, 3118. However, the bottom edge 3124 of the first flap 3120 is not directly coupled to any other waistband components and is freely moveable.

The second flap 3130 of the waistband 3100 also includes a top edge 3132 and a bottom edge 3134. The top edge 3132 of the second flap 3130 extends along the top edge 3112 of the waistband 3100. The top edge 3132 of the second flap 3130 is coupled to the resilient panel 3600, but is not coupled to the first flap 3120 and is therefore freely moveable relative to the first flap. The bottom edge 3134 of the second flap 3130 extends along the bottom edge 3114 of the waistband 3100 and is stitched or otherwise coupled to the bottom 3022 of the pants. The left and right sides of the second flap 3130 are also stitched or otherwise coupled to the left and right seams 3116, 3118, along with the left and right sides of the first flap.

The first flap 3120 and the second flap 3130 overlap on the exterior rear surface of the waistband 3100. In the disclosed embodiment, the entire exterior surface 3128 of the first flap 3120 is exposed on the exterior of the pants 3010, but only a portion of the second flap 3120 is exposed. In particular, the first flap 3120 covers an upper portion of the exterior surface 3136 of the second flap 3130, but a bottom portion of the exterior surface 3136 of the second flap 3130 is exposed on the exterior of the pants (i.e., the portion of the second flap 3130 below the arcuate bottom edge 3124 of the first flap is exposed on the exterior of the pants). The regions of the first flap 3120 and the second flap 3130 that overlap on the rear of the waistband (i.e., a region generally defined by the shape of the first flap 3120) may be referred to herein as "overlapping exterior surface portions" of the flaps.

As shown in FIGS. 16 and 19-21, the resilient panel 3600 is a sheet of resilient/elastomeric material that is folded and coupled to the first and second flaps in order to form a pleated pocket 3610 disposed on a central rear portion of an interior surface of the waistband 3100. Accordingly, the resilient panel 3600 is configured to form a "pocket panel" on the interior surface of waistband. As explained in further detail below, folds in the resilient panel form pleats 3612 that are disposed on the interior surface of the waistband 3100. The pleats 3612 (in addition to the resilient/elastomeric material of the panel itself) allow the pocket 3610 to be expanded in such a manner that the height of the pocket is adjustable. Because the size of the pocket formed by the resilient panel 3600 is adjustable, the pocket may also be referred to herein as a "dynamic pocket." The resilient panel 3600 may be provided by materials that are similar to those described above in association with the backing sheet 850 and/or backing material 2150. However, in at least some embodiments, it will be recognized that the resilient sheet 2600 may be substituted for a non-resilient sheet that only uses pleats to provide the adjustability in the height of the pocket.

Figure 20:
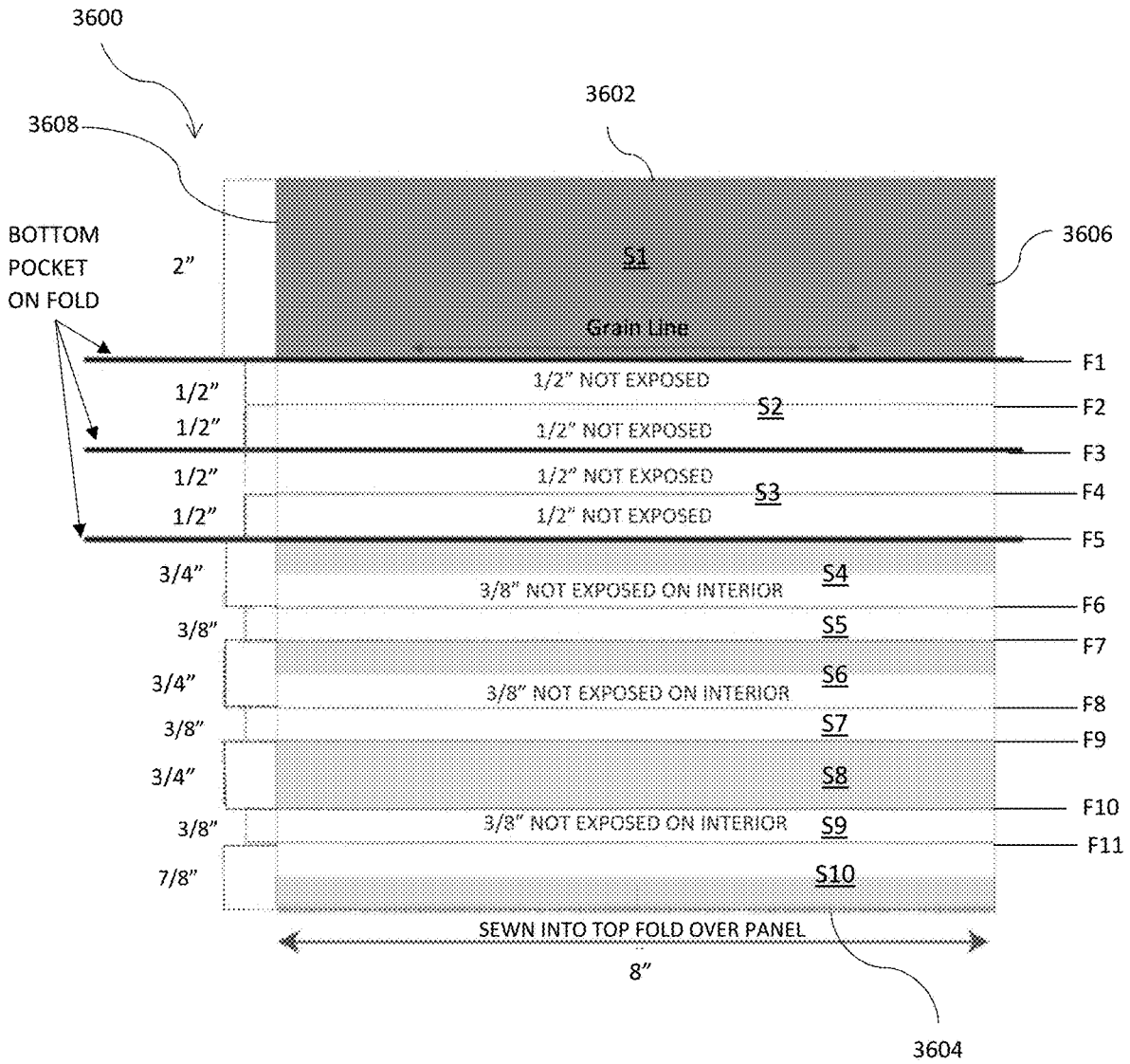
FIG. 20 illustrates a detailed view of the pocket panel of FIG. 19, where the pocket is isolated from the garment, completely unfolded and laid flat.

FIG. 20 shows the resilient panel 3600 in isolation from the pants 3010 and laid flat (i.e., unfolded) prior to assembly of the pleated pocket 3610 on the pants 3010. As shown in FIG. 20, the resilient panel 3600 may be provided by a four-sided sheet of material defining four perimeter portions (which may also be referred to as "sides" or "edges" of the resilient panel 3600). The panel 3600 is rectangular in shape and the four perimeter portions include a first perimeter portion 3602, a second perimeter portion 3604, a third perimeter portion 3606, and a fourth perimeter portion 3608. The first and second perimeter portions 3602, 3604 are opposite one another on the panel 3600, and the third and fourth perimeter portions 3606 and 3608 are also opposite one another on the panel 3600. As explained in further detail herein, when the resilient panel 3600 is disposed on the waistband 3100, the first and second perimeter portions 3602, 3604 extend in a lateral direction across the rear portion of the waistband 3100, and the third and fourth perimeter portions 3606, 3608 extend in a vertical direction on the rear portion of the waistband 3100.

With continued reference to FIG. 20, a plurality of laterally extending fold lines 3614 extend across the panel 3600 from left to right (i.e., from the fourth perimeter portion 3608 to the third perimeter portion 3606). The plurality of laterally extending fold lines 3614 include folds F1-F11 shown in FIG. 20. Fold lines F1, F3, F5, F7, F9 and F11 form lower folds on the panel 3600 (i.e., folds that go into the page in FIG. 20 and form lower fold lines on the pleated pocket 3610 when the resilient panel 3600 is arranged on the waistband 3100). Fold lines F2, F4, F6, F8, and F10 form upper folds on the panel 3600 (i.e., folds that come out of the page in FIG. 20 and form upper fold lines on the pleated pocket when arranged on the waistband). It will be noted that fold lines F1-F11 are also identified in FIG. 21 and can be recognized as either upper fold lines or lower fold lines based on the change in direction of the panel that results from the fold line. Fold lines F1, F3 and F5 define bottom fold lines on the pleated pocket 3610. In other words, the fold lines F1, F3 and F5 define the lowermost position of the pocket 3610 when the pocket is not in use.

Figure 19:
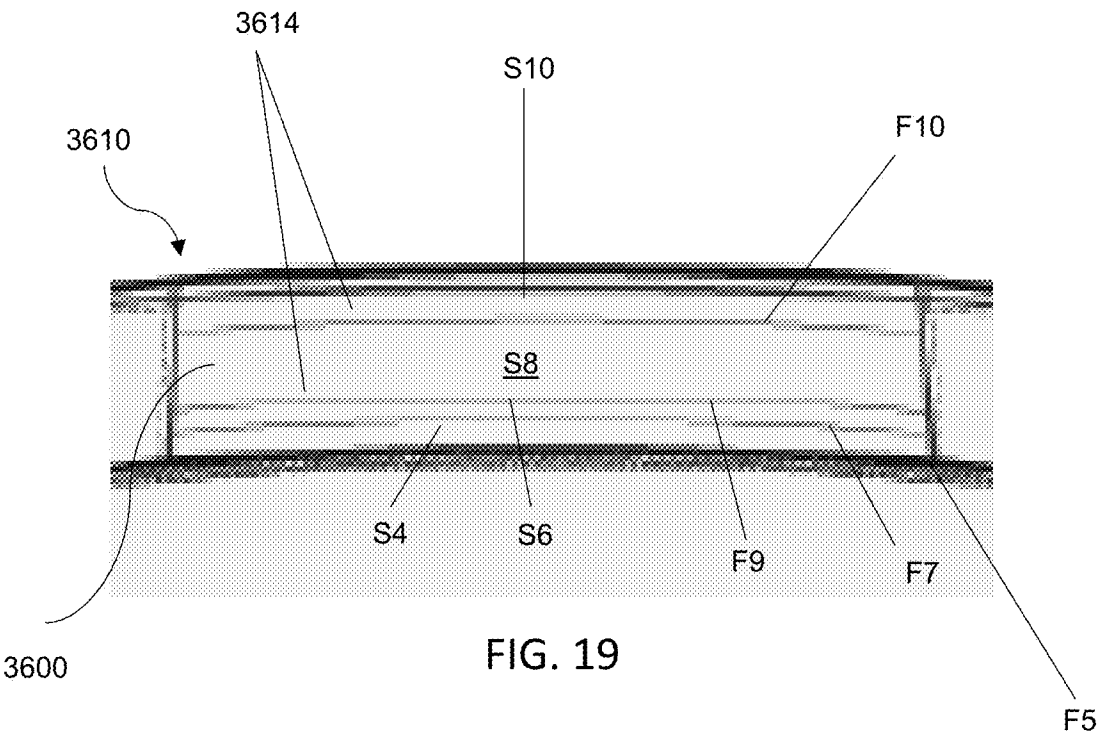
FIG. 19 illustrates a pocket formed by a pocket panel for the embodiment of the garment illustrated in FIG. 16, the pocket disposed on an interior waistband surface of the garment in the empty configuration.

With reference again to FIG. 20, various rectangular surface portions S1-S12 are defined between the fold lines F1-F11, and these rectangular surface portions S1-S12 form the pleats 3612 in the pocket 3610. Each of the surface portions S1-S12 has a same width that extends from the right side/third perimeter portion 3606 to the left side/fourth perimeter portion 3608 of the resilient panel 3600. For example, in the disclosed embodiment, the width of each surface portion S1-S12 is 8 inches. The surface portions S1-S12 are also defined by a number of different heights. The first rectangular surface portion S1 has the greatest height (e.g., 2 inches) of all the surface portions and thus defines the largest surface portion on the resilient panel 3600. This surface portion S1 provides the entire outer side of the pocket 3610 (i.e., the outward-facing side of the pocket), while the remaining surface portions S2-S12 form pleats on the inner side of the pocket (i.e., the inward user-facing side of the pocket). As shown in FIG. 20, surface portions S2-S5 may all have the same height (e.g., ½ inch), surface portions S6, S8 and S10 may all have the same height (e.g., ¾ inch), and surface portion S7, S9, and S11 may all have the same height (e.g., ⅜ inch). Surface portion S12 is the second largest surface portion (e.g., ⅞ inch) and provides the uppermost surface portion on the inner side of the pocket. The unique configuration of the resilient panel 3600 including fold lines F1-F11 and differently sized surface portions S1-S12 results in a unique pleated pocket configuration when the resilient panel is coupled to the waistband 3100. The shaded areas on surface portions S6, S8, S10 and S12 represent portions of the resilient panel 3600 that are exposed as pleats on the interior of the waistband when the resilient panel is coupled to the waistband 3100. These exposed portions of surface portions S6, S8, S10 and S12 are illustrated in FIG. 19 on an interior surface of the waistband 3100.

Figure 21:
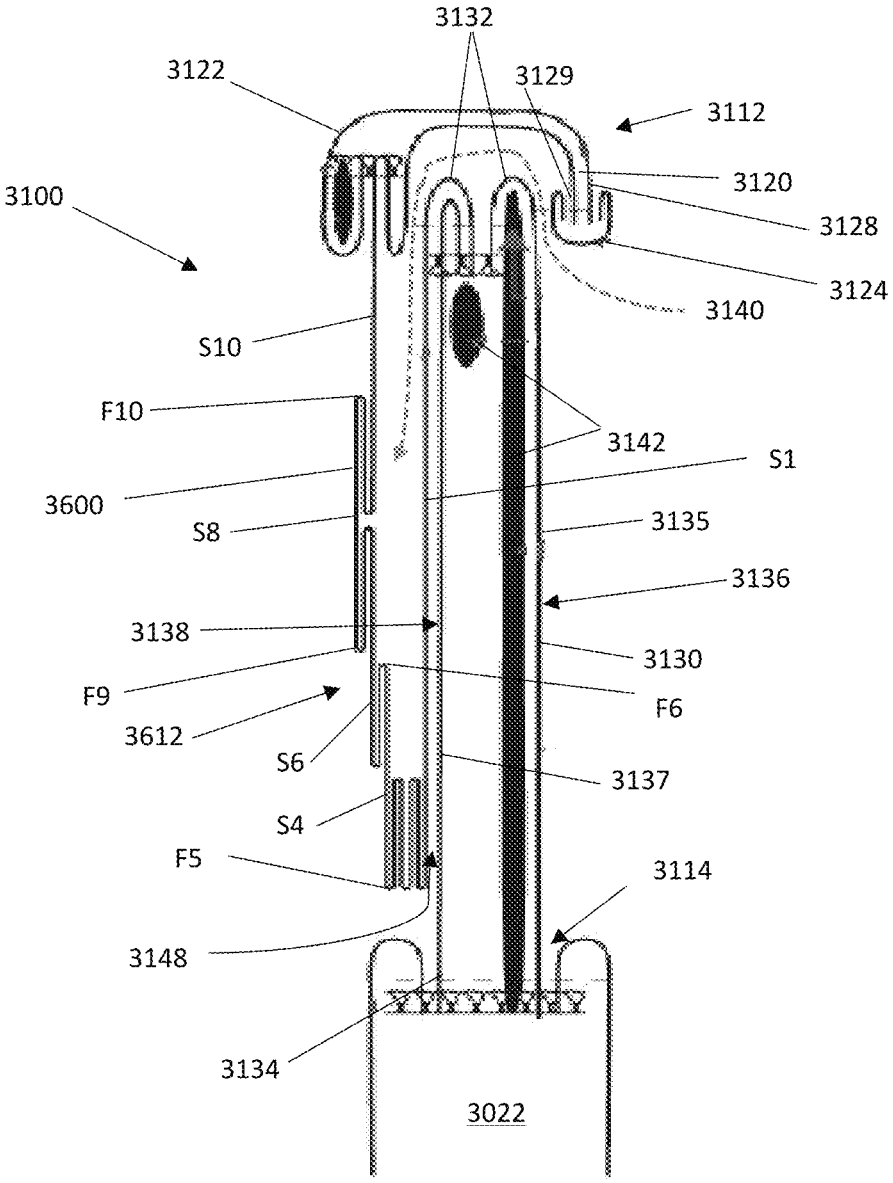
FIG. 21 illustrates a cross-sectional view of the pocket panel of FIG. 19 disposed on the waistband of the garment and in the empty configuration.

FIG. 21 shows a cross-sectional view of the resilient panel 3600 disposed on the waistband 3100 in order to form the pleated pocket 3610. As illustrated in FIG. 21, surface portion S1 defines an outer side of the pocket 3610, while surface portions S2-S12 define pleats 3612 on an inner side of the pocket 3610 (i.e., the side that faces the wearer). Fold lines F1, F3 and F5 define a bottom of the pocket 3610. Surface portions S6-S12 and their associated fold lines F5-F11 define a number of visible pleats 3612 on the interior surface of the waistband arranged between the bottom and the top of the pocket 3610. Each of the pleats 3612 extends laterally between a left perimeter portion and a right perimeter portion of the pocket panel. The top of the pocket 3610 is defined opposite these fold lines F1, F3, F5, near the top edge 3112. At the top of the pocket 3610, an opening to a pocket cavity 3140 is formed between the first perimeter portion 3602 and the second perimeter portion 3604.

The first perimeter portion 3602 of the resilient panel 3600 is stitched or otherwise coupled to the top edge 3132 of the second flap 3130. The length of the first perimeter portion 3602 of the resilient panel 3600 is substantially similar to that of the top edge 3132 of the second flap 3130, and the two are coupled together along this entire length. Similarly, the second perimeter portion 3604 of the resilient panel 3600 is stitched or otherwise coupled to the top edge 3122 of the first flap 3120. The length of the second perimeter portion 3604 of the resilient panel 3600 is substantially similar to that of the top edge 3122 of the first flap 3120, and the two are coupled together along this entire length. Because the top edge 3122 of the first flap 3120 and the top edge 3132 of the second flap 3130 both extend laterally along the top edge 3112 of the waistband 3100, it will be appreciated that both the first perimeter portion 3602 and the second perimeter portion 3604 of the resilient panel also extend laterally along the top edge 3112 of the waistband.

In the disclosed embodiment, the second flap 3130 is a dual layer flap, including an outward layer 3135 that provides the exterior surface 3136 of the second flap 3130, and an inward layer 3137 that provides the interior surface 3138 of the second flap 3130. One or more lengths of elastic material 3142 may be positioned in the waistband 3100, including between the outward layer 3135 and the inward layer 3137, to add further resiliency and strength to the waistband.

As best illustrated in FIG. 21, an opening 3140 to the pocket 3610 is defined between the laterally-extending first perimeter portion 3602 and second perimeter portion 3604 of the resilient panel 3610. Because of the couplings between the resilient panel 3610 and the flaps 3120 and 3130, this opening 3140 is similarly defined between the top edge 3122 of the first flap 3120 and the top edge 3132 of the second flap 3130. Furthermore, because the first flap 3120 is separable from the second flap 3130 along the top of the waistband, it will be recognized that the opening 3140 to the pocket cavity may be accessed by pulling the first flap 3120 away from the second flap 3130. Thus, although the path to the opening 3140 is illustrated with a curved dotted line in FIG. 21, it will be recognized that accessing the opening 3140 to the pocket cavity is similar to that described previously in association with FIGS. 15A and 15B. In other words, the opening 3140 may be accessed by (i) pulling the bottom edge 3124 of the first flap 3120 upward (and outward), thus separating the exterior surface portions of the first flap 3120 from the exterior surface portions of the second flap 3130, (ii) grasping the top edge 3132 of the second flap 3130, and then (iii) pulling the top edge 3132 of the second flap 3130 and the associated second perimeter portion 3604 of the resilient panel 3600 downward (and outward), thus separating the first perimeter portion 3602 from the second perimeter portion 3604 of the resilient panel 3600 and exposing the opening 3140 to the cavity of the pocket 3610.

It will be recognized from FIGS. 20 and 21 that the resilient panel 3600 is not coupled to the waistband along the length of the bottom folds F1, F3 and F5. Thus, while the pocket 3610 formed by the resilient panel 3600 is coupled to the waistband 3100 along the upper and lateral sides of the pocket, the bottom of the pocket is uncoupled from the waistband 3100. More specifically, the first perimeter portion 3602 and the second perimeter portion 3604 of the resilient panel 3600 are coupled to the top edge 3112 of waistband (i.e. along the top edge 3122 of the first flap 3120 and the top edge 3132 of the second flap 3130, respectively), and the third perimeter portion 3606 and the fourth perimeter portion 3608 of the resilient panel are coupled to the lateral portions of the waistband (i.e., along the right seam 3116 and the left seam 3118, respectively), but the bottom fold lines F1, F3 and F5 of the resilient panel 3600 are free of coupling to the waistband along the length of such fold lines (i.e., between the right side and the left side of such fold lines). Accordingly, as can be seen in FIG. 21, an accessible space 3148 is provided between the outward side S1 of the pocket panel 3610 and the flaps 3120 and 3130 of the waistband. A user may insert their hand or object into this accessible space 3148, if needed (e.g., to help in straightening or flattening the pocket).

The garment with a waistband pocket as described in association with FIGS. 16-21 may be used in association with a method of storing an object, such as a smartphone, wallet, or keys, for example. The method includes obtaining the garment (such as that described above in association with FIGS. 16-21), the garment including a waistband with an opening to a pocket cavity that is defined between the laterally extending first end and the laterally extending second end of a resilient sheet that forms a pocket, the resilient sheet including a plurality pleats defined by a plurality of fold lines, wherein the plurality of pleats are configured to unfold along the plurality of fold lines to increase a height of the pocket cavity. The method further includes separating the first flap of the garment from the second flap of the garment along overlapping exterior surface portions on the exterior of the waistband, thus exposing the pocket cavity. The method further includes inserting an object into the pocket cavity such that the pleats at least partially unfold along the plurality of fold lines and increase the height of the pocket panel (similar to that of FIGS. 6A-6C).

Figure 22:
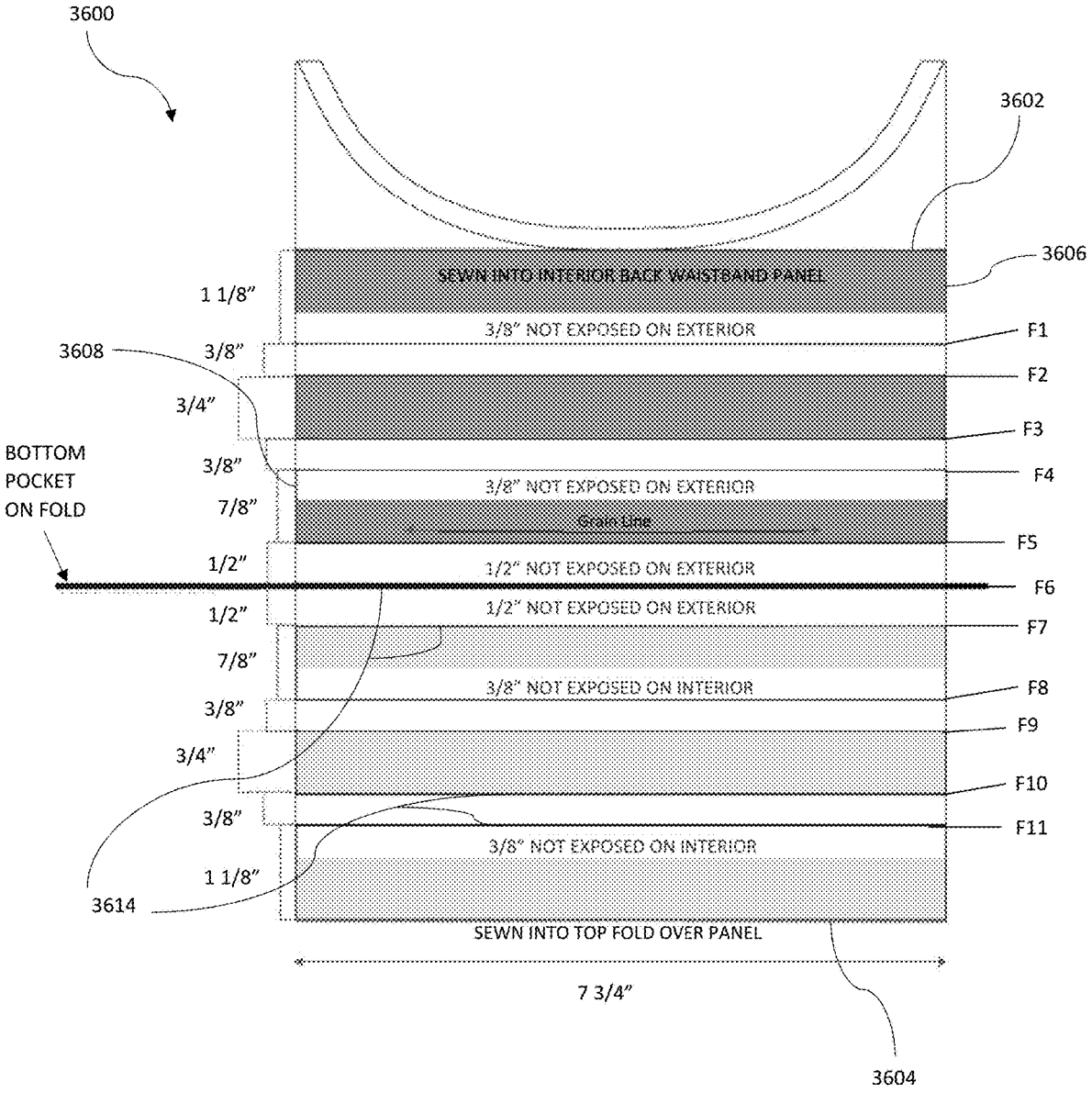
FIG. 22 illustrates an alternative embodiment of the pocket panel of FIG. 20.
Figure 23:
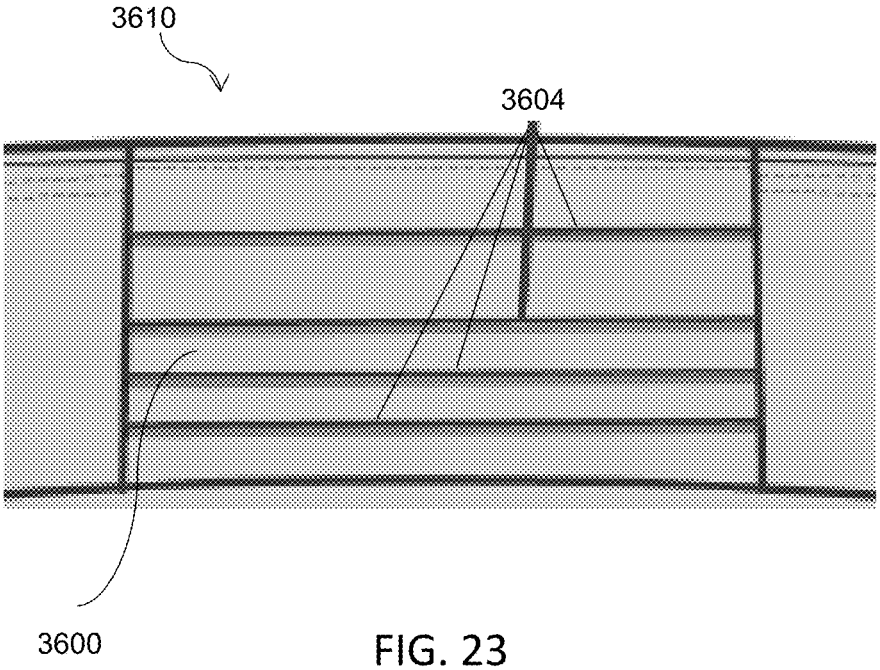
FIG. 23 illustrates an interior view of the pocket panel of FIG. 22, the pocket disposed on an interior waistband surface of the garment in the empty configuration.

One configuration of the pleated pocket is illustrated in FIGS. 16-21, but it will be recognized that many other configurations are possible. For example, FIGS. 22-23 illustrate another embodiment of the pleated pocket wherein different fold lines 3614 (including fold lines F1-F11) are formed on the resilient sheet 3600. These fold lines result in differently sized surface portions between the fold lines 3614. As a result, differently sized pleats 3612 are formed in the pleated pocket 3610 shown in FIGS. 22-23 from the pleated pocket shown in FIGS. 16-21. Also, the pleated pocket 610 of FIGS. 22-23 includes pleats on both sides of the pocket (i.e., both the inward side and outward side), while the pleated pocket of FIGS. 16-21 only includes pleats on one side of the pocket (i.e., the inward side, as the outward side provided by surface portion S1 does not include pleats in FIGS. 16-12). While FIGS. 16-23 illustrate two different versions of the pleated pocket 3610, it will be recognized that many different variations of the pocket are possible and contemplated herein.

While the invention has been shown and described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A garment comprising:

a lower portion configured to be positioned around at least one leg of a person wearing the garment; and a waistband coupled to the lower portion and configured to be oriented around a waist of the person wearing the garment, the waistband including:

a first flap including a top edge and an opposite arcuate edge; and a second flap including a top edge and an opposite bottom edge, wherein the first flap and the second flap overlap on the waistband of the garment; and a pocket panel coupled to the waistband of the garment, the pocket panel defining a pocket with an opening to the pocket, wherein the opening to the pocket is defined along a laterally-extending first perimeter portion of the pocket panel and a laterally-extending second perimeter portion of the pocket panel, the first flap coupled to the first perimeter portion of the pocket panel and the second flap coupled to the second perimeter portion of the pocket panel.

2. The garment of claim 1 wherein the first flap and the second flap are both at least partially exposed on an exterior rear side of the garment.

3. The garment of claim 2 wherein the arcuate edge of the first flap is disposed over the second flap on the exterior rear side of the garment.

4. The garment of claim 1 wherein the waistband includes a plurality of pleats, the plurality of pleats defining a plurality of fold lines extending laterally between a left perimeter portion and a right perimeter portion of the pocket panel.

5. The garment of claim 4 wherein the plurality of fold lines include a laterally extending bottom fold that defines a bottom of the pocket.

6. The garment of claim 5 wherein the plurality of pleats are configured to at least partially unfold along the plurality of fold lines to increase a height of the pocket panel.

7. The garment of claim 6 wherein the left perimeter portion of the pocket panel is coupled to both a left edge of the first flap and a left edge of the second flap, wherein the right perimeter portion of the pocket panel is coupled to both a right edge of the first flap and a right edge of the second flap, and wherein the bottom fold line of the pocket is free of couplings between a left side and a right side of the bottom fold line.

8. The garment of claim 7 wherein the pocket panel includes a plurality of surface portions that define the pleats between the fold lines, the plurality of surface portions including at least one surface portion on an outward side of the pocket panel and multiple surface portions on an inward side of the pocket panel.

9. The garment of claim 1 wherein the waistband of the garment includes an upper perimeter and a lower perimeter, wherein both the first perimeter portion and the second perimeter portion of the pocket panel are disposed along the upper perimeter of the waistband.

10. A garment comprising:

a waistband including:

a first flap including a top edge and an opposite lower edge; and a second flap including an upper edge and an opposite bottom edge, wherein the first flap and the second flap overlap on the waistband of the garment; and a pocket panel coupled to the waistband of the garment, the pocket panel defining a pocket with an opening to the pocket, wherein the opening to the pocket is defined along a laterally-extending first perimeter portion of the pocket panel and a laterally-extending second perimeter portion of the pocket panel, the first flap coupled to the first perimeter portion of the pocket panel and the second flap coupled to the second perimeter portion of the pocket panel.

11. The garment of claim 10 wherein the first flap and the second flap are both at least partially exposed on an exterior rear side of the garment.

12. The garment of claim 10 wherein the lower edge of the first flap is an arcuate edge.

13. The garment of claim 12 wherein the lower edge of the first flap is disposed over the second flap on an exterior rear side of the garment.

14. The garment of claim 10 wherein the waistband includes a plurality of pleats, the plurality of pleats defining a plurality of fold lines extending laterally between a left perimeter portion and a right perimeter portion of the pocket panel.

15. The garment of claim 14 wherein the plurality of pleats are configured to at least partially unfold along the plurality of fold lines to increase a height of the pocket panel.

16. The garment of claim 10 wherein the first perimeter portion of the pocket panel is coupled to both a left edge of the first flap and a left edge of the second flap, and wherein the second perimeter portion of the pocket panel is coupled to both a right edge of the first flap and a right edge of the second flap.

17. A garment comprising:

a lower portion configured to be positioned around at least one leg of a person wearing the garment; and a waistband coupled to the lower portion and configured to be oriented around a waist of the person wearing the garment, the waistband including:

a first flap including a top edge and an opposite bottom edge; and a second flap including a top edge and an opposite bottom edge, wherein the first flap and the second flap overlap on the waistband of the garment; and a pocket panel coupled to the waistband of the garment, the pocket panel defining a pocket with an opening to the pocket, wherein the opening to the pocket is defined along a laterally-extending first perimeter portion of the pocket panel and a laterally-extending second perimeter portion of the pocket panel, the top edge of the first flap and the first perimeter portion of the pocket panel coupled to a top portion of the waistband, and the top edge of the second flap coupled to the second perimeter portion of the pocket panel at a position below the top portion of the waistband.

18. The garment of claim 17, and wherein at least one edge of the first flap and the second flap is an arcuate edge.

19. The garment of claim 18 wherein the arcuate edge extends from a first end to a second end with a middle portion positioned between the first end and the second end, wherein the middle portion is free from connection to other portions of the waistband or the pocket panel.

20. The garment of claim 17, wherein the top edge of the first flap is sewn to the first perimeter portion of the pocket panel at the top portion of the waistband.

* * * * *